US005268716A

United States Patent [19]

Ito

[11] Patent Number: 5,268,716

[45] Date of Patent: Dec. 7, 1993

[54] DATA ENTRY METHOD AND APPARATUS FOR AN ELECTROPHOTOGRAPHIC COPYING MACHINE

[75] Inventor: Masazumi Ito, Toyohashi, Japan

[73] Assignee: Minolta Camera Kabushiki Kaisha, Japan

[21] Appl. No.: 907,652

[22] Filed: Jul. 2, 1992

Related U.S. Application Data

[60] Division of Ser. No. 733,358, Jul. 19, 1991, Pat. No. 5,172,167, which is a continuation of Ser. No. 105,906, Oct. 7, 1987, abandoned.

[30] Foreign Application Priority Data

Oct. 7, 1986 [JP] Japan ..... 61-238291
Oct. 7, 1986 [JP] Japan ..... 61-238292
Oct. 7, 1986 [JP] Japan ..... 61-238293

[51] Int. Cl.[5] ..... G03G 21/00; G03G 15/00
[52] U.S. Cl. ..... 355/202
[58] Field of Search ..... 355/202, 210, 214, 218

[56] References Cited

U.S. PATENT DOCUMENTS

| | | | |
|---|---|---|---|
| 3,792,913 | 2/1974 | Simmons | 355/218 |
| 4,017,173 | 4/1977 | Komori et al. | 355/235 |
| 4,068,948 | 1/1978 | Ritzerfeld | 355/75 |
| 4,256,400 | 3/1981 | Komori et al. | 355/218 |
| 4,417,805 | 11/1983 | Kishi | 355/243 X |
| 4,551,008 | 11/1985 | Banton | 355/202 |
| 4,582,417 | 4/1986 | Yagasaki et al. | 355/218 |
| 4,640,601 | 2/1987 | Deguchi et al. | 355/218 |
| 4,679,927 | 7/1987 | Sogo et al. | 355/218 |
| 4,701,044 | 10/1987 | Horiuchi et al. | 355/218 |
| 4,733,266 | 3/1988 | Watanabe | 355/218 X |
| 4,734,789 | 3/1988 | Smith et al. | 358/300 |
| 4,752,809 | 6/1988 | Ito | 355/218 |
| 4,774,546 | 9/1988 | Corona et al. | 355/244 |
| 4,887,129 | 12/1989 | Shenoy et al. | 355/218 |

FOREIGN PATENT DOCUMENTS

| | | |
|---|---|---|
| 57-41671 | 3/1982 | Japan . |
| 57-56859 | 4/1982 | Japan . |
| 58-43480 | 3/1983 | Japan . |
| 60-130782 | 7/1985 | Japan . |

*Primary Examiner*—Fred L. Braun
*Attorney, Agent, or Firm*—Price, Gess & Ubell

[57] ABSTRACT

A data entry apparatus for an electrophotographic copying machine which forms an image of a document on a photoconductor and transfers the image to a paper, including data input keys for specifying data to be written, a position entry device for specifying an area on a document in the unit of a block which can divide the whole area of the document into a plurality of blocks and for displaying those blocks on a panel in order to choose either one of them, a data write member for writing entered data on an area of the photoconductor corresponding to the area specified with respect to the document while the light from the specified are of the document cut off is also provided.

2 Claims, 20 Drawing Sheets

1202

| coordinate | length of movement |
|---|---|
| 1 ≦ W ≦ 12 | 0 mm |
| 13 ≦ W ≦ 24 | 40 mm |
| 25 ≦ W ≦ 36 | 80 mm |
| 37 ≦ W ≦ 48 | 120 mm |
| 49 ≦ W ≦ 60 | 160 mm |
| 61 ≦ W ≦ 72 | 200 mm |
| 73 ≦ W ≦ 84 | 240 mm |
| 85 ≦ W ≦ 96 | 280 mm |

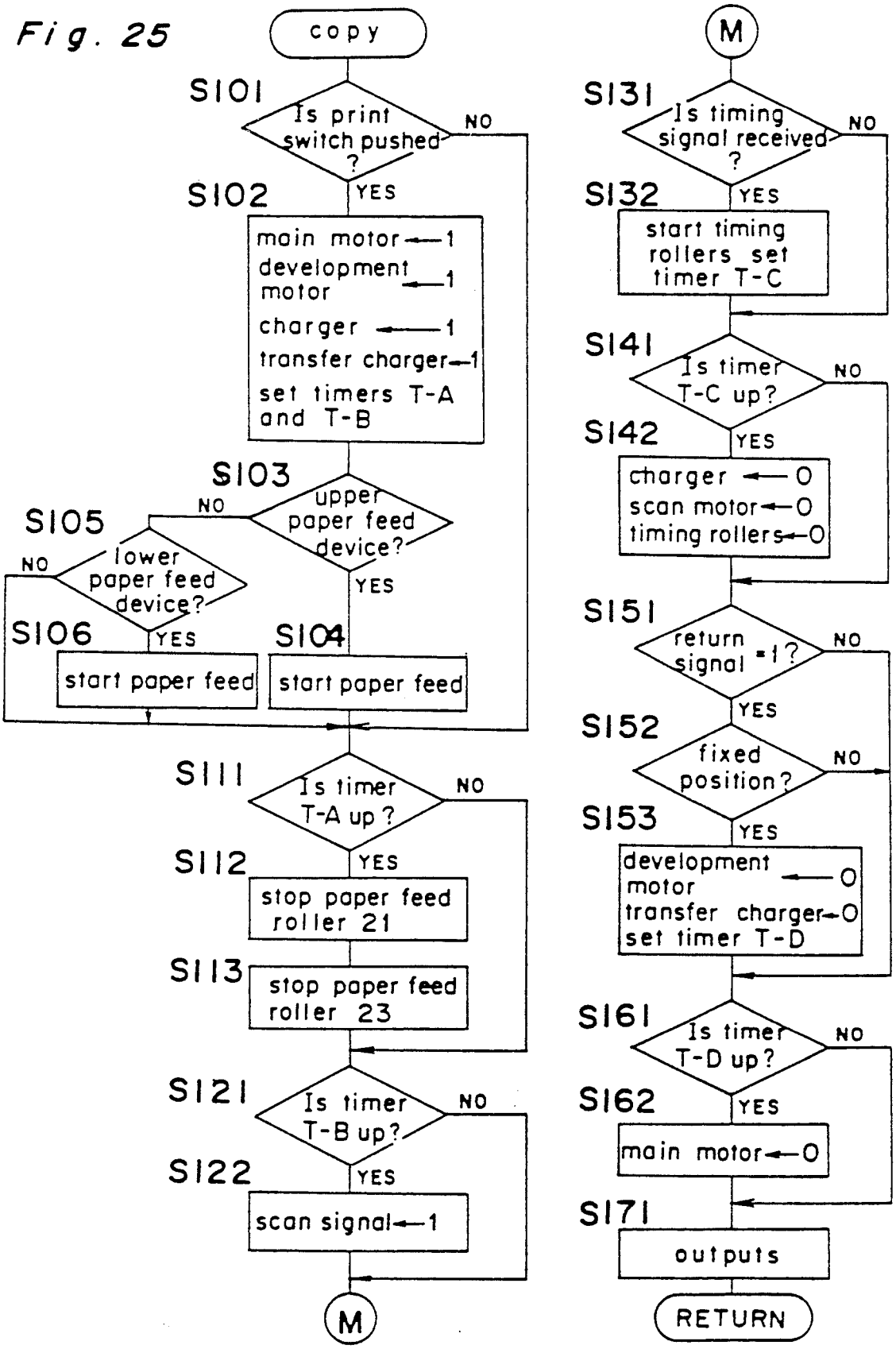
Fig. 25
copy
S101
Is print switch pushed ?
NO
YES
S102
main motor ← 1
development motor ← 1
charger ← 1
transfer charger ← 1
set timers T-A and T-B
S103
upper paper feed device?
NO
YES
S105
lower paper feed device?
NO
YES
S106
start paper feed
S104
start paper feed
S111
Is timer T-A up ?
NO
YES
S112
stop paper feed roller 21
S113
stop paper feed roller 23
S121
Is timer T-B up?
NO
YES
S122
scan signal ← 1
M
M
S131
Is timing signal received ?
NO
YES
S132
start timing rollers set timer T-C
S141
Is timer T-C up?
NO
YES
S142
charger ← 0
scan motor ← 0
timing rollers ← 0
S151
return signal = 1 ?
NO
YES
S152
fixed position?
NO
YES
S153
development motor ← 0
transfer charger ← 0
set timer T-D
S161
Is timer T-D up?
NO
YES
S162
main motor ← 0
S171
outputs
RETURN

DATA ENTRY METHOD AND APPARATUS FOR AN ELECTROPHOTOGRAPHIC COPYING MACHINE

This is a division of U.S. application Ser. No. 07/733,358filed on Jul. 19, 1991, now U.S. Pat. No. 5,172,167, for a DATA ENTRY APPARATUS, which is a file wrapper continuation application of U.S. Ser. No. 07/105,906, filed on Oct. 7, 1987, now abandoned.

BACKGROUND OF THE INVENTION

1. Field of the Invention

The present invention relates to a data entry apparatus for an electrophotographic copying machine.

2. Description of the Prior Art

Recently, a variety of data entry apparatus has been proposed or provided for an electrophotographic copying machine. This data entry apparatus can shade a prescribed area of a photoconductor such as a side end part of document image when the photoconductor is exposed to a document image and can write data such as date or the like in the shaded area with a data writing head such as a light-emitting diode (LED) array. Thus, a copy of a synthesized latent image of document with this data is formed so as to yield a copy of the composite image (see, for example, Japanese Patent laid open Publication No. 130782/1985).

Usually, the area on a document in which data is to be written is fixed as to a conventional data entry apparatus. It is possible to specify an arbitrary area by the data entry apparatus if a cathode ray tube is used therefor. However, it increases cost thereof.

Further, an editor being connectable to a copying machine which provides editorial functions such as "deletion" and/or "move" has been known. In such an editor, various methods are proposed for specifying an area to be edited. Even such an editor needs to connect a costly apparatus such as a keyboard in order to enter desired data which include alphanumeric characters or kanas (Japanese characters).

An LED array used as a data writing head should have a resolution high enough to write data on a photoconductor. The cost of such an LED array as wide as the photoconductor is very high because of a large number of LEDs and its drivers and the case design necessary to prevent leakage of light. Therefore, an LED array for a data writing head is desirable to be small. However, if such a small LED array is fixed, the position of data entry is also fixed.

SUMMARY OF THE INVENTION

An object of the present invention is to provide a data entry apparatus which can enter an arbitrary data.

Another object of the present invention is to provide a data entry apparatus which can specify a data entry area easily.

A further object of the present invention is to provide a data entry apparatus which can enter data at any arbitrary desired area.

A first data entry apparatus for an electrophotographic copying machine according to the present invention data comprises input means for specifying data to be written; position entry means for specifying an area on a document in the unit of a block which provides means for dividing the whole area of the document into a plurality of blocks and for displaying those blocks on a panel in order to choose either one of them; and data write means for writing entered data on an area of the photoconductor corresponding to the area specified with respect to the document while the light from the specified area of the document is cut off.

A second data entry apparatus for an electrophotographic copying machine according to the present invention comprises key entry means including a plurality of keys arranged on a panel; means for specifying a first mode wherein an entry position is specified according to an input through the key entry means or a second mode wherein data to be copied is specified according to an input through the key entry means; position entry means for specifying a data writing area on a document in the unit of a block by operating one of keys of the key entry means when the first mode is specified wherein individual key inputs are assigned to a plurality of blocks being defined by dividing the whole area of a document; data entry means for specifying data to be written by operating at least one of the keys of the key entry means when the second mode is specified wherein individual key inputs are assigned to characters, numerals and the like; data write means for writing entered data on an area of the photoconductor corresponding to the area specified with respect to the document while the light from the specified area of the document is cut off.

An advantage of a data entry apparatus according to the present invention is that the location of a data entry position can be understood readily by a user by referring to a document.

Another advantage of a data entry apparatus according to the present invention is that both entry area and entry data can be specified with the same data input means.

A further advantage of a data entry apparatus according to the present invention is that data write means and shading means can be made compact.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings:

FIG. 25 is a flowchart of copy routine;

DETAILED DESCRIPTION OF THE PREFERRED EMBODIMENTS

Figure 1:
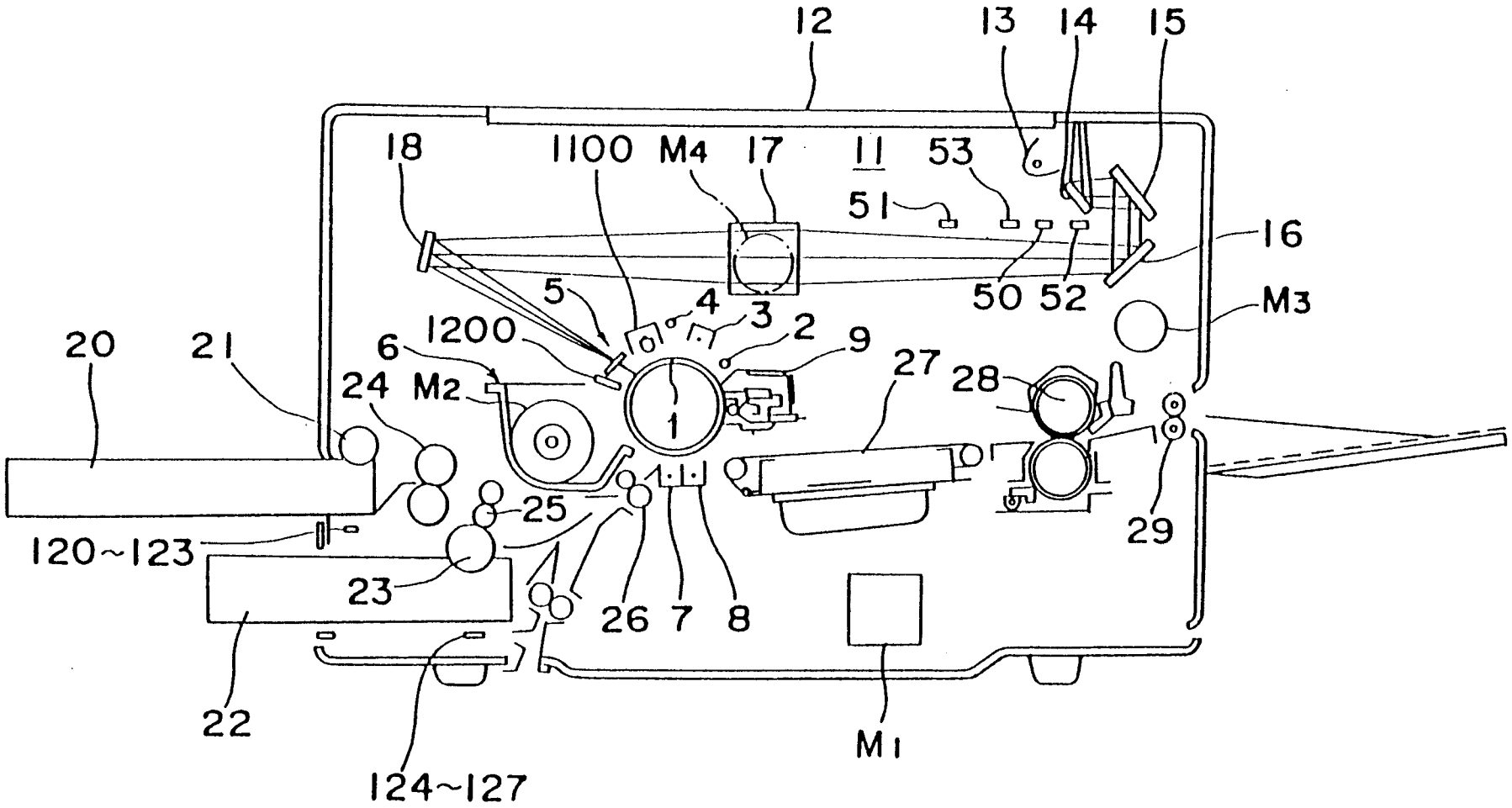
FIG. 1 is a perspective view of a copying machine.

Referring now to the drawings wherein like reference numerals designate corresponding parts throughout the drawings, preferred embodiments of the invention will be explained in the following order:

(a) copying machine and entry mechanism, (b) editor, (c) flow of the control of the copying machine, and (d) flow of the control of the editor.

(a) Copying Machine and Input Device

FIG. 1 shows an example of a copying machine according to this invention. A photoconductor drum 1 which can rotate counterclockwise is situated in the central part of the copying machine. Around the photoconductor drum 1 are arranged a main eraser lamp 2, a charger 3, a sub-eraser lamp 4, an input device 5, a developer 6, a transfer charger 7, a charger 8 for the separation of a paper, and a cleaner 9 with a blade. The photoconductor drum 1 has a photoconductive layer on the surface. The photoconductor is sensitized or charged by passing the eraser lamps 2, 4 and the charger 3, and then it is exposed to an image of a document sent from an optical system 11.

The optical system 11 is located under a platen glass 12 so as to scan a image of a document placed on the platen glass 12, and it consists essentially of a light source 13, movable mirrors 14, 15, 16, a lens 17 and a mirror 18. A first scanner carrying the light source 13 and the movable mirror 14 can move to the left at a rate v/m, wherein v is a circumferencial speed constant irrespectively of the copy magnification power m, while a second scanner carrying the movable mirrors 15, 16 move also to the left at a rate v/2 m so as to keep the length of the light path constant. They are driven by a DC motor M3. When the copy magnification power m is changed, the lens 17 is moved by a lens motor M4 along the optical axis thereof according to the magnification power m, accompanying the movement and pivotal motion of the mirror 18.

Figure 2:
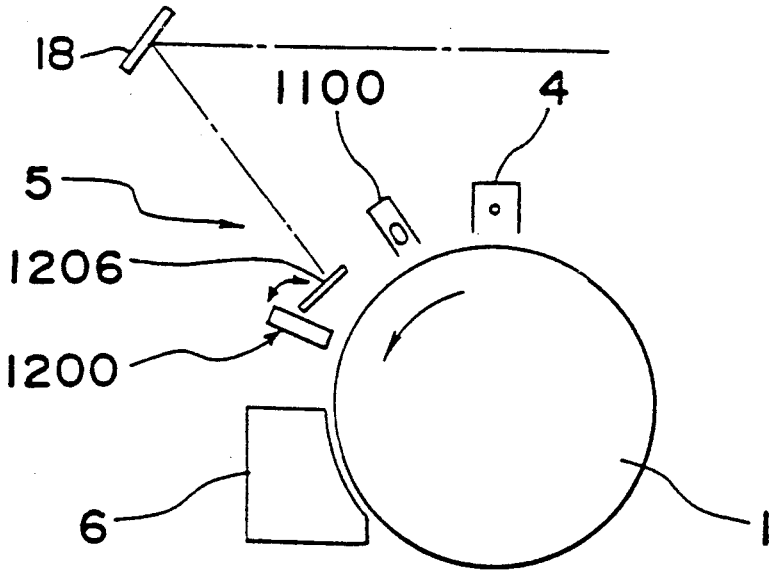
FIG. 2 is a sectional view of an input device.
Figure 3:
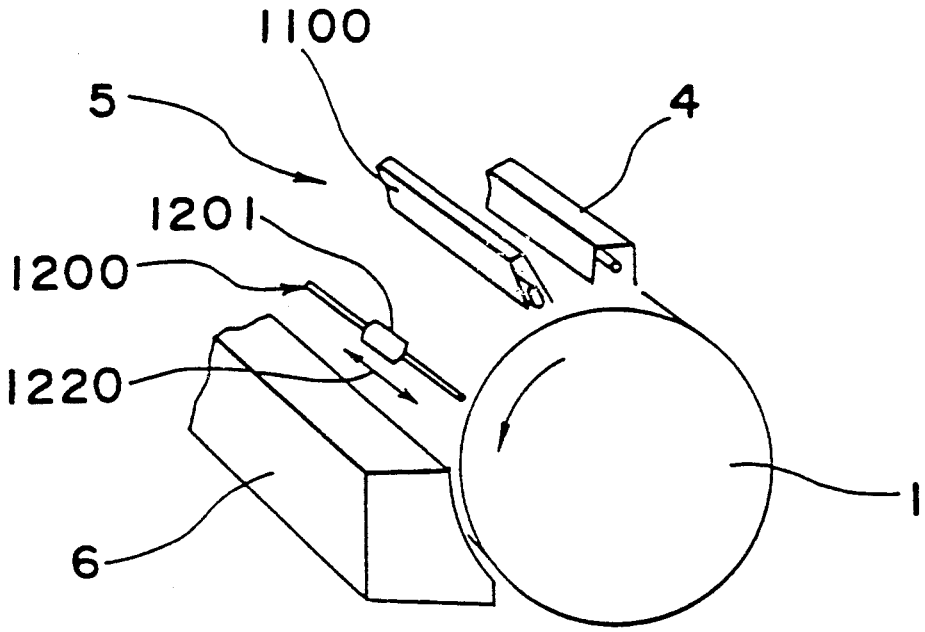
FIG. 3 is a perspective view of the input device.

The input device 5, which is also shown in FIGS. 2 and 3, consists essentially of a mid-image eraser 1100 for erasing an area between two latent images and side area of the latent image according to the magnification m, and an LED writing device 1200. A switch 52 is set so as to stop the action of the mid-image eraser 1100 when switched on by the first scanner of the optical system 11. Another switch 53 is set so as to give the timing at the top of a latent image on the photoconductor drum 1 when switched on by the first scanner.

In the left side of the copying machine, there are provided paper-feed devices 20, 22 which have paper-feed rollers 21, 23, respectively. The carriage path of a paper is constructed by a pair of rollers 24, 25, a pair of timing rollers 26, a carriage belt 27, a fixer device 28 and a pair of discharge rollers 29. The carriage system and the photoconductor drum 1 are driven by a main motor M1.

Figure 4:
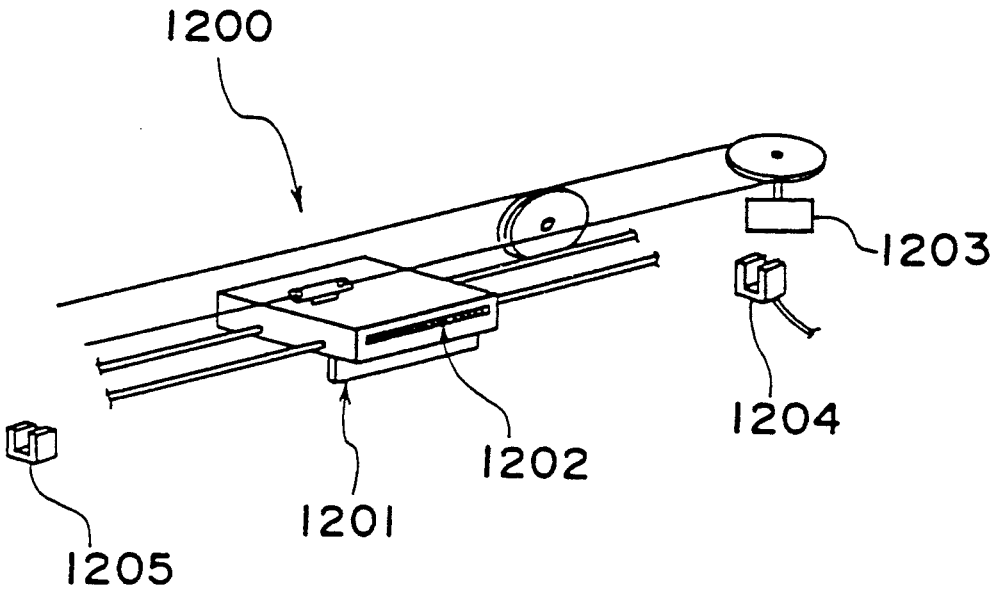
FIG. 4 is a perspective view of an LED writ head.
Figure 5:
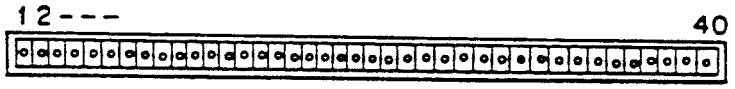
FIG. 5 is a plan view of an LED array.

FIG. 4 shows the LED entry device 1200 which provides an LED writing head 1201 with an LED array 1202 of forty LEDs aligned at the pitch of 1 mm as shown in FIG. 5. The writing head 1201 can be moved by a stepping motor 1203 to the left or right along a pair of guide rods parallel to the axis of the drum 1 as indicated by an arrow 1220. Sensor 1204 and 1205 are arranged at both stroke ends of the writing head 1201, respectively, in order to detect the position of the head 1201 so that they can be turned on by an interrupter fixed on the bottom of the housing of the head 1201.

The head 1201 is moved by the stepping motor 1203 in this embodiment. However, if an LED array 1202 which extends over the axial length of the drum 1 is available, such a motor is not needed.

Further, the LED entry device 1200 provides a shutter 1206 carried on the head 1201, as shown in FIG. 2, and the shutter 1206 is actuated so as to shade the light path of a document image to the drum 1 when a solenoid (not shown) is energized.

Figure 6:
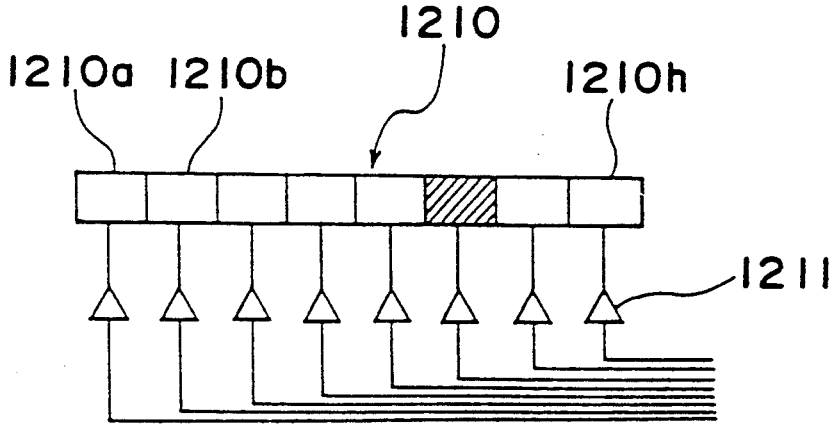
FIG. 6 is a schematic diagram of a liquid crystal shutter.

FIG. 6 shows another shutter 1210 made of a liquid crystal. The liquid crystal shutter 1210 is divided into eight blocks from 1210*a* to 1210*h* each having a width of 40 mm which are arranged linearly and parallel to the axial direction of the drum 1. Each block can be driven independently by a driver 1211 according to a signal sent from a first CPU 201 (see FIG. 9). Thus, the light path can be shaded in the unit of 40 mm (for example, a hatched part in FIG. 6) along the lengthwise direction of the LED head 1201.

Figure 7:
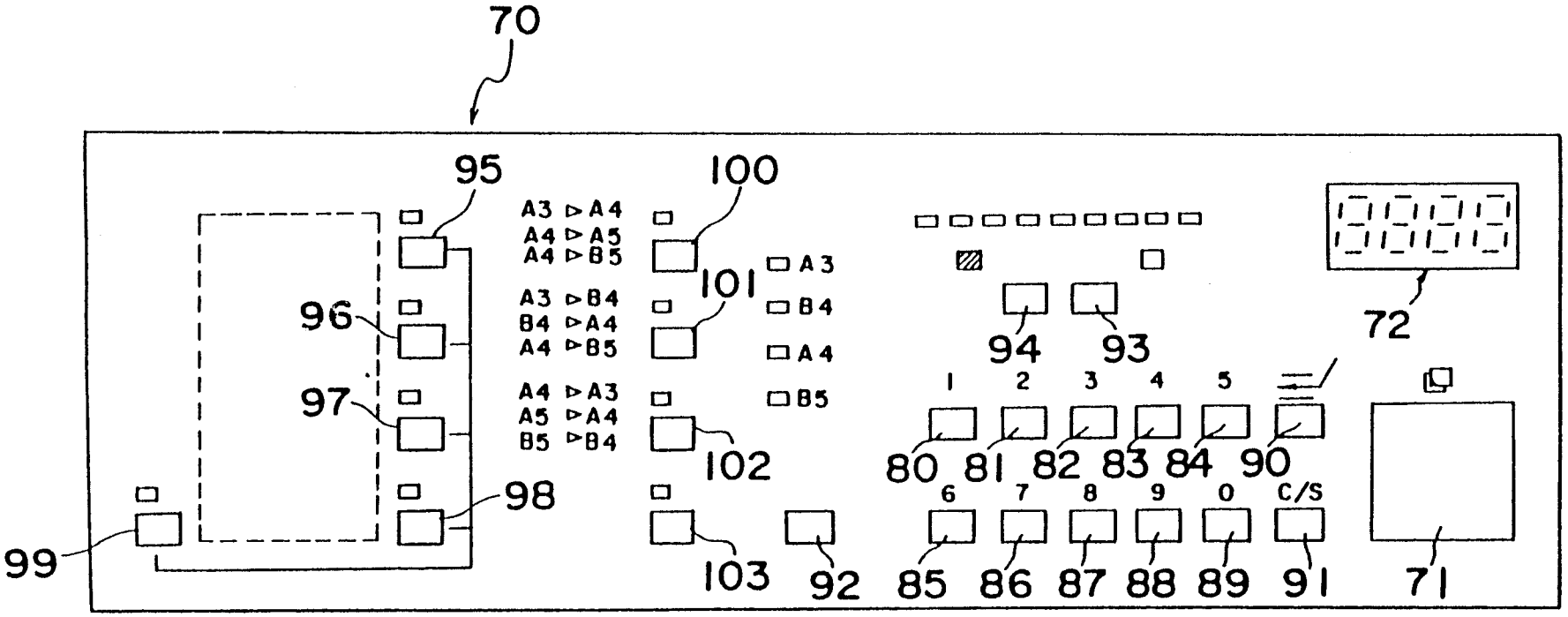
FIG. 7 is a plan view of an operational panel.

FIG. 7 shows the arrangement of keys and displays on an operational panel 70 of the copying machine. The panel 70 has a print key 71 for the start of the copying cycle, a numerical display 72 of four figures, ten-keys 80–89 for entering respective numerals from 0 to 9, an interruption key 90 for indicating an interruption copying operation, a clear/stop key 91, a paper selection key 92 for designating the size of a copy paper, an up and down keys 93, 94 for changing or designating the density of copy stepwise, and keys 95–103 for designating the magnification of copy.

Keys 95 to 98 are used for setting and designating desired magnifications, while keys 100 to 103 are used for designating predetermined magnifications for transforming one document size to one copy-paper size, respectively, and a key 99 is used to designate the mode for setting a desired magnification power. When the mode for setting a desired magnification power is selected by operating the key 99, a desired magnification power is set by operating ten-keys and the magnification set is memorized in a memory corresponding to one of keys 95 to 98 when it is operated.

Figure 8:
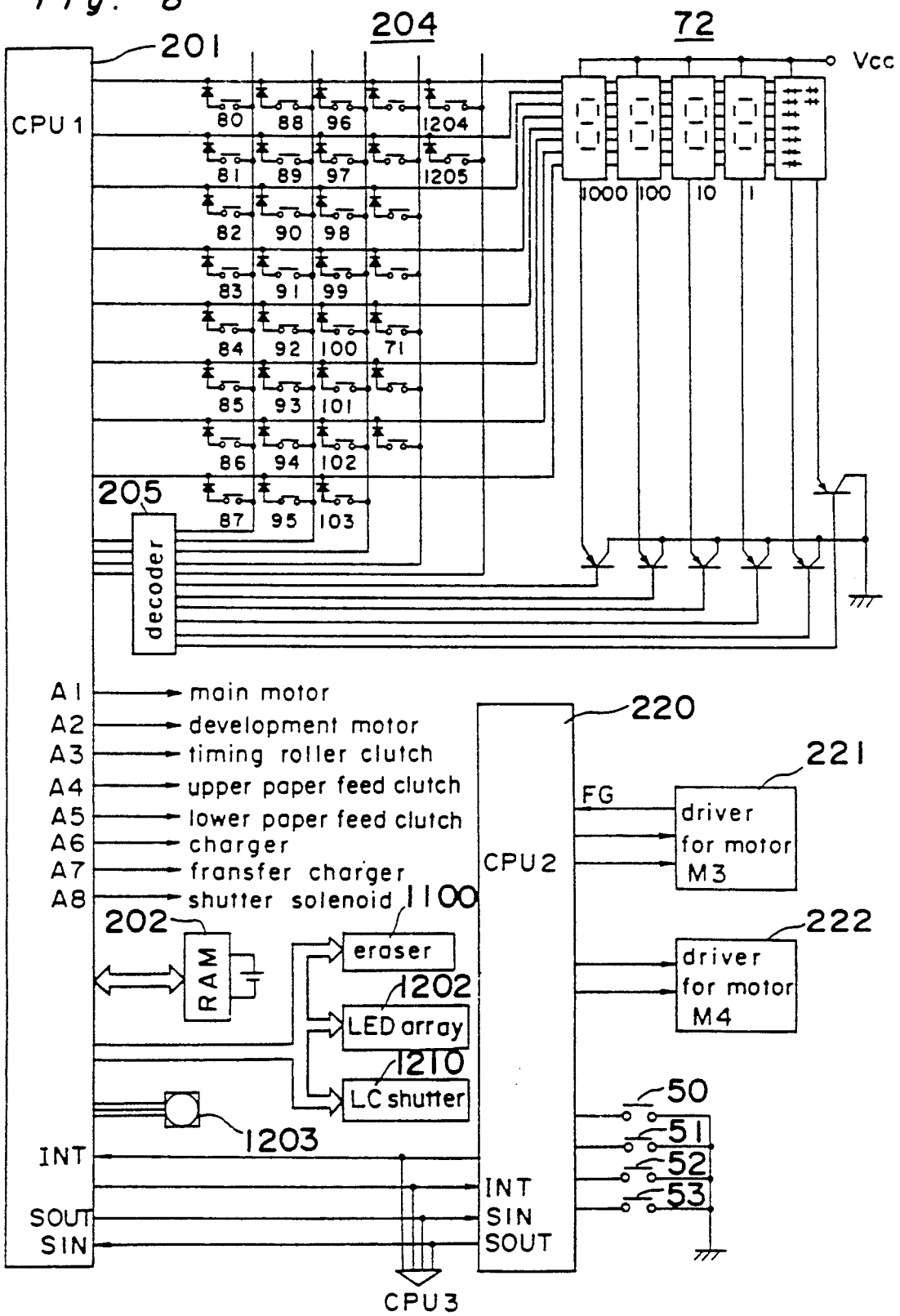
FIG. 8 is an electrical circuit diagram of the first CPU which controls the copying machine.

FIG. 8 shows an electrical circuit for controlling a copying machine according to this invention. A first CPU (one-chip microprocessor) 201 controls a second CPU 221 for controlling the optical system 11 and a third CPU (refer FIG. 16) 2300 for controlling an editor 2000, which will be explained later, through an interruption terminal INT and data input terminals SIN, SOUT. A RAM 202 with a backup battery is used as a work area of the first CPU 201 for storing various data such as copy magnification. A switch matrix 204 and the display 72 are connected to output terminals of the first CPU 201 and a decoder 205 which is also connected to output terminals of the first CPU 201. The output terminals A1 to A8 of the first CPU 201 are connected to drivers (not shown) for driving the main motor M1, a development motor M2, a clutch for the timing rollers 26, a clutch for the upper paper feed roller 21, a clutch for the lower paper feed roller 23, the charger 5, the transfer charger 7 and the shutter solenoid for driving the shutter 1206, respectively. The first CPU 201 is also connected to the mid-image eraser 1100, the LED array 1202, the liquid crystal shutter 1210 if any, and the stepping motor 1203.

A driver 221 of a DC motor M3 for scanning of a document and a driver 222 of a stepping motor M4 for varying magnification as well as the switches 50 to 54 are connected to the second CPU 220.

Figure 9:
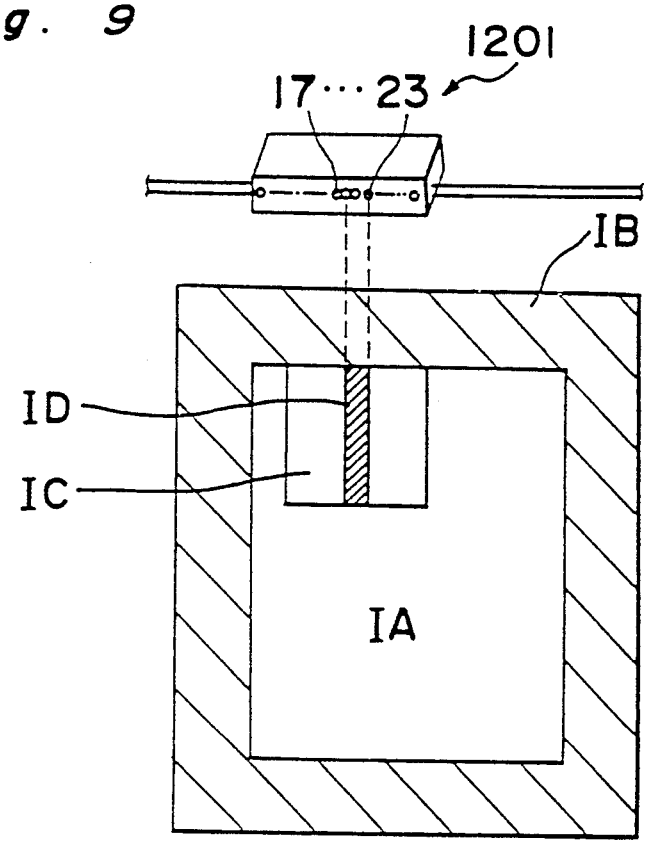
FIG. 9 is a diagram which shows the relation between the LED head and a latent image on the photoconductor drum.

FIG. 9 shows a relation between the LED head 1201 and a latent image on the photoconductor drum 1. In FIG. 9, the LED head 1201 has moved by the stepping motor 1203 to a position determined based on input data from the editor 2000. The development elevation of the photoconductor drum 1 is shown schematically; that is, IA is an area on which a latent image of a document is formed. IB is an area outside the area IA to be erased by the mid-image eraser 1100 which also acts as a side eraser, IC is an area designated by the editor 2000 wherein a data is to be written, and ID is a longitudinal area when the longitudinal direction is designated as the area writing direction. (The area ID may also be a horizontal area if desired.) In the situation shown in FIG. 9, the input data is written by seven LEDs from No. 17 to No. 23 of the array 1202, and the other LEDs Nos. 1 to 16 and 24 to 40 play a role of eraser for erasing both side areas of the area ID in the area IC:

The timings for turning on and off respective LEDs of the LED array 1202 are controlled according to the revolution rate of the drum 1 so that the time unit may corresponds to a pitch of 1 mm when seen in the rotation direction of the drum 1.

Figure 10:
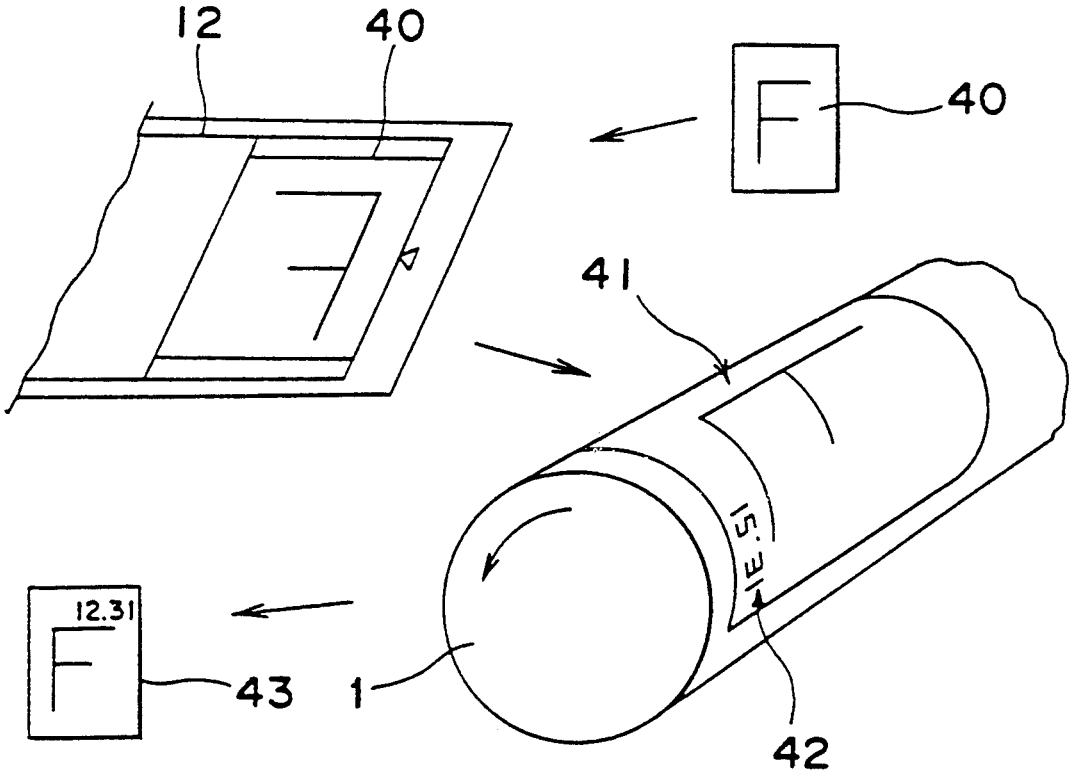
FIG. 10 is a diagram which shows the steps of the data input in a document.

FIG. 10 schematically shows processes starting from a document 40 until a copy 43 of the document 40 is obtained. The document 40 on which a character "F" is written is placed on the platen glass 12 at first. When the copy process is started, latent images 41 and 42 of the document 40 and an entry data of a date, "12.31", are formed on the photoconductor drum 1, respectively, and they are transferred to a copy paper 43 as toner images according to the well known electrophotographic process. The latent image 42 of the write data is formed in the right-hand side above the latent image 41 of the document.

Figure 11:
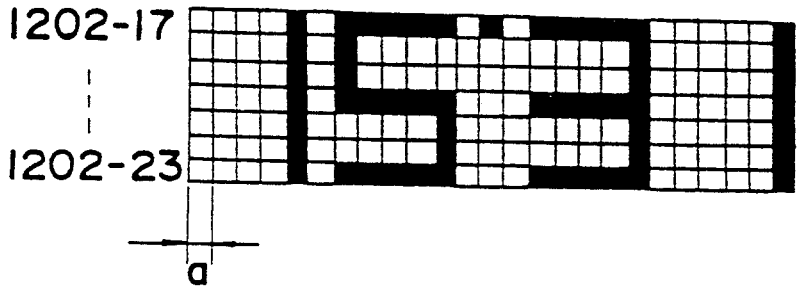
FIGS. 11 and 12 are diagrams of examples of input data, respectively.

FIG. 11 shows an example of a dot matrix for showing a driving method of the LED array 1202 in the case that the date of "12.31" (Dec. 31) as entry data is to be written along a vertical area as indicated by ID in in FIG. 9. Each of seven light-emitting diodes (LEDs) of, for example, NOs. 17 to 23 of the LED array 1202 is turned on or off in the predetermined order as shown in the dot matrix according to the rotation of the photoconductor drum 1. In other words, the seven LEDs of Nos. 17 to 23 are all lighted first. Next, the photoconductor drum 1 is rotated by an angle corresponding to four dots 4 * a, and the LEDs are all turned off in order to write "1". Then, the photoconductor drum 1 is rotated further by an angle corresponding to one dot a, and the LEDs are all lighted again. Next, the photoconductor drum 1 is rotated further by an angle of one dot a, and only LEDs of Nos. 21 and 22 are lighted. Then, the photoconductor drum 1 is rotated further by an angle of one dot a, and only LEDs of Nos. 18, 19, 21 and 22 are lighted. After the photoconductor drum 1 is rotated further by an angle of four dots 4*a*, LEDs of Nos. 18 and 19 are lighted. Thus, "2" is written on the drum 1. Subsequently, ".", "3" and "1" are written similarly.

Figure 12:
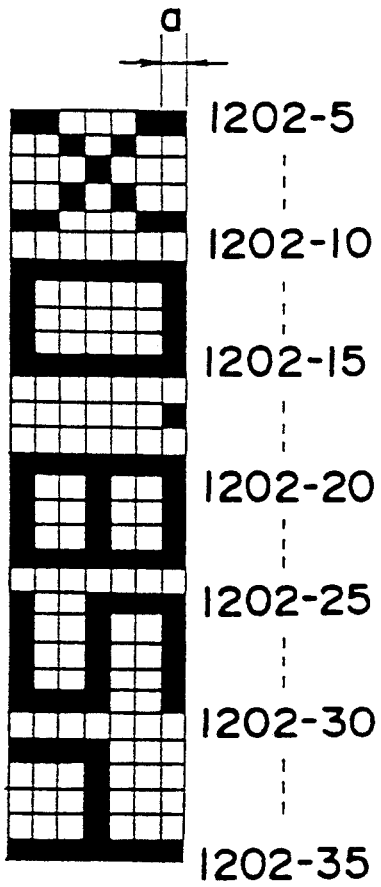

FIG. 12 shows an example of a dot matrix for driving the LED array 1202 in the case that a magnification of "×0.824" is to be written along a horizontal line. This data can be written similarly with thirty one LEDs of NOs. 5 to 35 of the LED array 1202.

Entry data such as the date and magnification are stored in an integrated circuit 230 for clock and a random access memory 203 backed up with a battery, respectively, and they can be displayed on the numerical display 72 through first CPU 201.

(b) Editor

Figure 13:
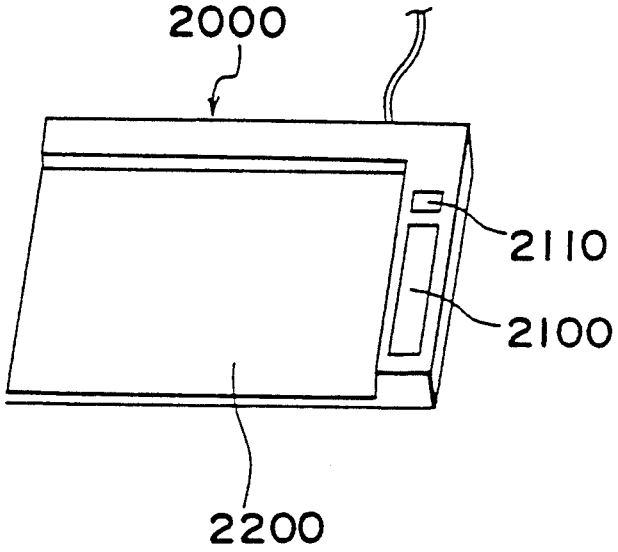
FIG. 13 is a perspective view of an editor.

FIG. 13 shows an editor 2000 for specifying an area for editing and for entering data. The editor 2000 has an area 2200 provided for designating an editorial area and entering data, an operational panel 2100 and a liquid crystal display 2110 for displaying data entered. In this embodiment, the editor 2000 has a function to designate a data entry area. This gives the editor 2000 an additional merit.

Figure 14:
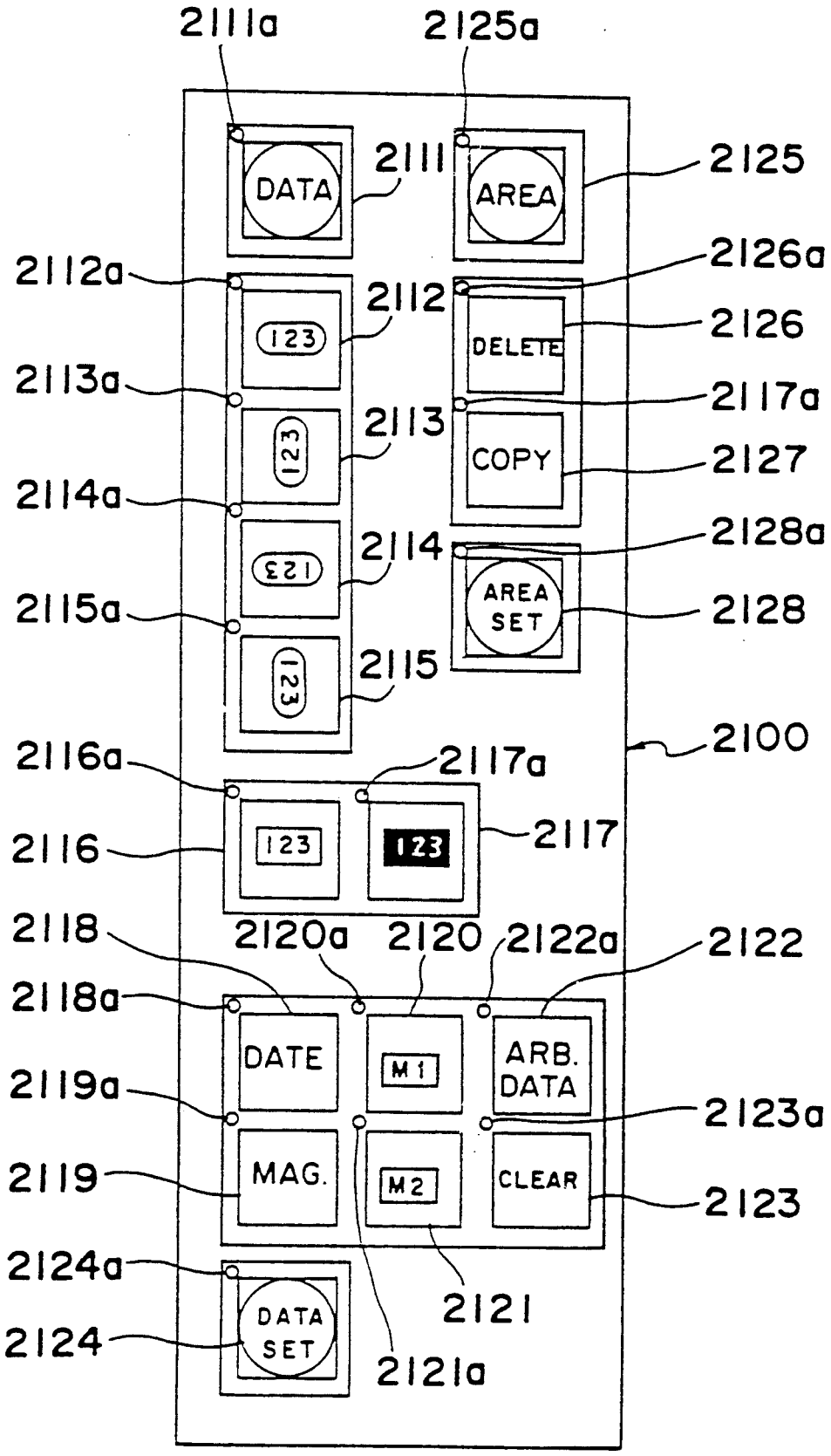
FIG. 14 is a plan view of an operational panel of the editor.

FIG. 14 shows the arrangement of keys 2111 to 2128 and LEDs 2111*a* to 2128*a*, respectively, corresponding to the keys 2111 to 2128 on the operational panel 2100. The key 2111 is provided for beginning the input of the entry position of data. Keys 2112 to 2115 are provided for designating the direction of entry data, keys 2116 and 2117 for designating negative or positive copy of the entry data, respectively. A key 2118 is provided for designating the date as entry data. A key 2119 is provided for designating magnification as entry data. Keys 2120 and 2121 are provided for storing arbitrary data to be entered by a user, a key 2122 is provided for starting the entry of an arbitrary data stored, a key 2123 is provided for clearing a wrong data, a key 2124 is provided for setting all designations regarding the entry of data, a key 2125 is provided for starting the designation of area for the edition of image, keys 2126 and 2127 are provided for designating deletion and for copy of the entry data, respectively, and a key 2128 is provided for setting the designated area for the edition of image.

Figure 15:
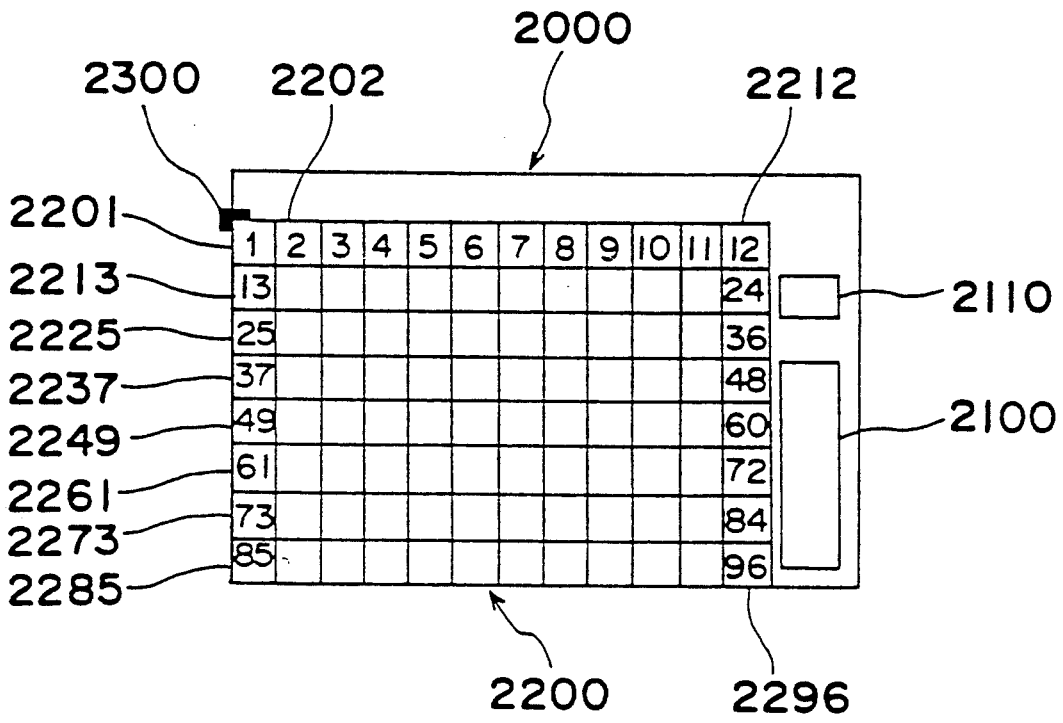
FIG. 15 is a plan view of an example of an edition area.

FIG. 15 shows the editor 2000 having the editorial and data writing area 2200 which provides many keys 2201 through 2296 for designating an arbitrary area.

The numerals on the keys 2201 to 2296 represent respective orders of small squares defined on the area 2200. A number of reference numbers are omitted in FIG. 15 for simplicity. In this case, the area 2200 consists of a matrix of 12×8 of keys 2201 to 2296, and each key corresponds to a square of 40 mm×40 mm. The square can be specified as a minimum unit on the edition of image. An input data is written within one square. A corner 2300 for adjusting a document can be moved according to the size of a document. This makes the correspondence between the position on a document and that of a key easily understandable.

If a document is placed on the area 2200 of a the editor 2000, the write position of a data can be specified easily because the result can be understood readily.

Figure 16:
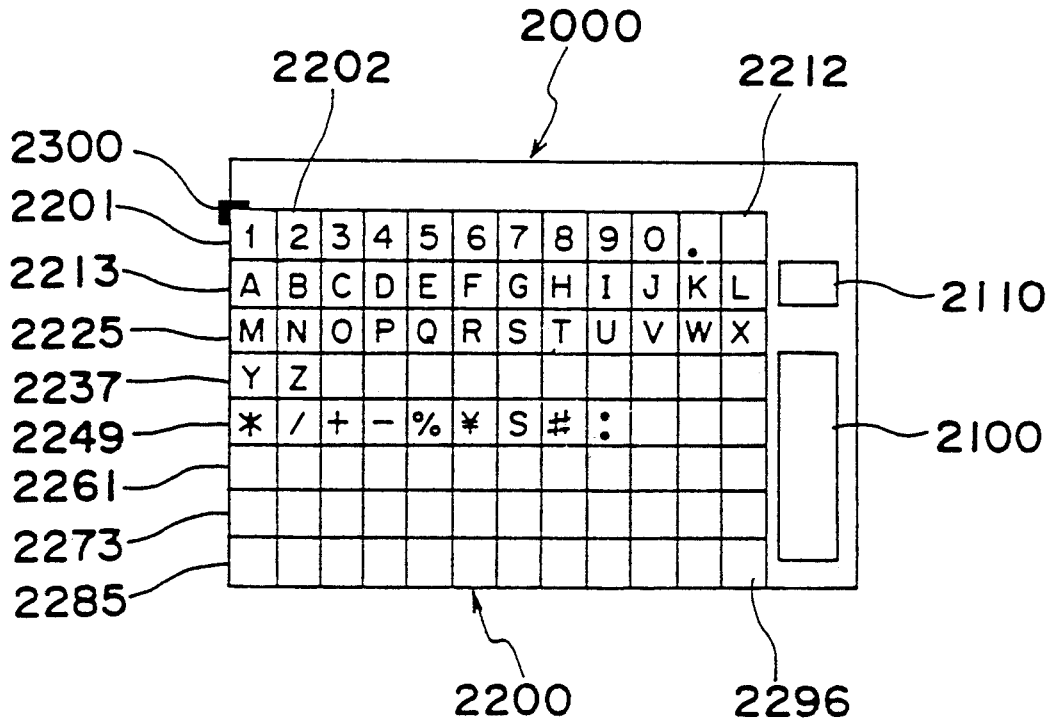
FIG. 16 is a plan view of another example of an edition area.

FIG. 16 shows the area 2200 when it is used for the entry of desired data. In this case, the above-mentioned keys 2201 to 2296 become input keys of the alphabet, numerals and signs, which may be displayed lightly on the surfaces of individual key, or may be printed on a transparent plastics film being able to cover on the area 2200. The area 2200 may be a graphic liquid crystal display on which transparent touch sensors are adhered for indicating positions, so that the contents of the display can be switched from the content of FIG. 15 to that of FIG. 16 or vice versa. Two kinds of displays may be printed on a sheet in each area so that a back light of LEDs or the like illuminates only the selected display. Further, the area 2200 may consist of a rotatable display so that the mode of a display of each area is changed by rotation.

A following table shows an example of digital data for driving the LED array 1202 sent to the first CPU 201 from the third CPU 2300 which controls the editor 2000 in the case shown in FIG. 12. The data "1" indicates the lighting of an LED and, when lighted, the corresponding latent image is erased and, therefore, it is not developed. The data "0" indicates the putting out of an LED. In this case, the corresponding latent image remains and, therefore, it is developed.

If the inversion from the positive to the negative is designated, the driving data of the LEDs effective for forming the image of entry data (LEDs NOs. 5 to 35 in the above-mentioned example) are reversed from "0" to "1" or vice versa. LEDs except them (LED No. 1 to 4 and 36 to 40) are lighted constantly for erasing.

TABLE

| | LED No. of LED array | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 |
| timing 1 | 1 | 1 | 1 | 1 | 0 | 1 | 1 | 1 | 0 | 1 | 0 | 0 | 0 | 0 | 0 | 1 | 0 | 1 | 0 | 0 |
| timing 2 | 1 | 1 | 1 | 1 | 0 | 1 | 1 | 1 | 0 | 1 | 0 | 1 | 1 | 1 | 0 | 1 | 1 | 1 | 0 | 1 |
| timing 3 | 1 | 1 | 1 | 1 | 1 | 0 | 1 | 0 | 1 | 1 | 0 | 1 | 1 | 1 | 0 | 1 | 1 | 1 | 0 | 1 |
| timing 4 | 1 | 1 | 1 | 1 | 1 | 1 | 0 | 1 | 1 | 1 | 0 | 1 | 1 | 1 | 0 | 1 | 1 | 1 | 0 | 0 |
| timing 5 | 1 | 1 | 1 | 1 | 1 | 0 | 1 | 0 | 1 | 1 | 0 | 1 | 1 | 1 | 0 | 1 | 1 | 1 | 0 | 1 |
| timing 6 | 1 | 1 | 1 | 1 | 0 | 1 | 1 | 1 | 0 | 1 | 0 | 1 | 1 | 1 | 0 | 1 | 1 | 1 | 0 | 1 |
| timing 7 | 1 | 1 | 1 | 1 | 0 | 1 | 1 | 1 | 0 | 1 | 0 | 0 | 0 | 0 | 0 | 1 | 1 | 1 | 0 | 0 |
| | 21 | 22 | 23 | 24 | 25 | 26 | 27 | 28 | 29 | 30 | 31 | 32 | 33 | 34 | 35 | 36 | 37 | 38 | 39 | 40 |
| timing 1 | 0 | 0 | 0 | 1 | 0 | 0 | 0 | 0 | 0 | 1 | 1 | 1 | 1 | 1 | 0 | 1 | 1 | 1 | 1 | 1 |
| timing 2 | 1 | 1 | 0 | 1 | 0 | 1 | 1 | 1 | 1 | 1 | 1 | 1 | 1 | 1 | 0 | 1 | 1 | 1 | 1 | 1 |
| timing 3 | 1 | 1 | 0 | 1 | 0 | 1 | 1 | 1 | 1 | 1 | 1 | 1 | 1 | 1 | 0 | 1 | 1 | 1 | 1 | 1 |
| timing 4 | 0 | 0 | 0 | 1 | 0 | 0 | 0 | 0 | 0 | 1 | 0 | 0 | 0 | 0 | 0 | 1 | 1 | 1 | 1 | 1 |
| timing 5 | 1 | 1 | 0 | 1 | 1 | 1 | 1 | 1 | 0 | 1 | 0 | 1 | 1 | 1 | 0 | 1 | 1 | 1 | 1 | 1 |
| timing 6 | 1 | 1 | 0 | 1 | 1 | 1 | 1 | 1 | 0 | 1 | 0 | 1 | 1 | 1 | 0 | 1 | 1 | 1 | 1 | 1 |
| timing 7 | 0 | 0 | 0 | 1 | 0 | 0 | 0 | 0 | 0 | 1 | 0 | 1 | 1 | 1 | 0 | 1 | 1 | 1 | 1 | 1 |

Figure 17:
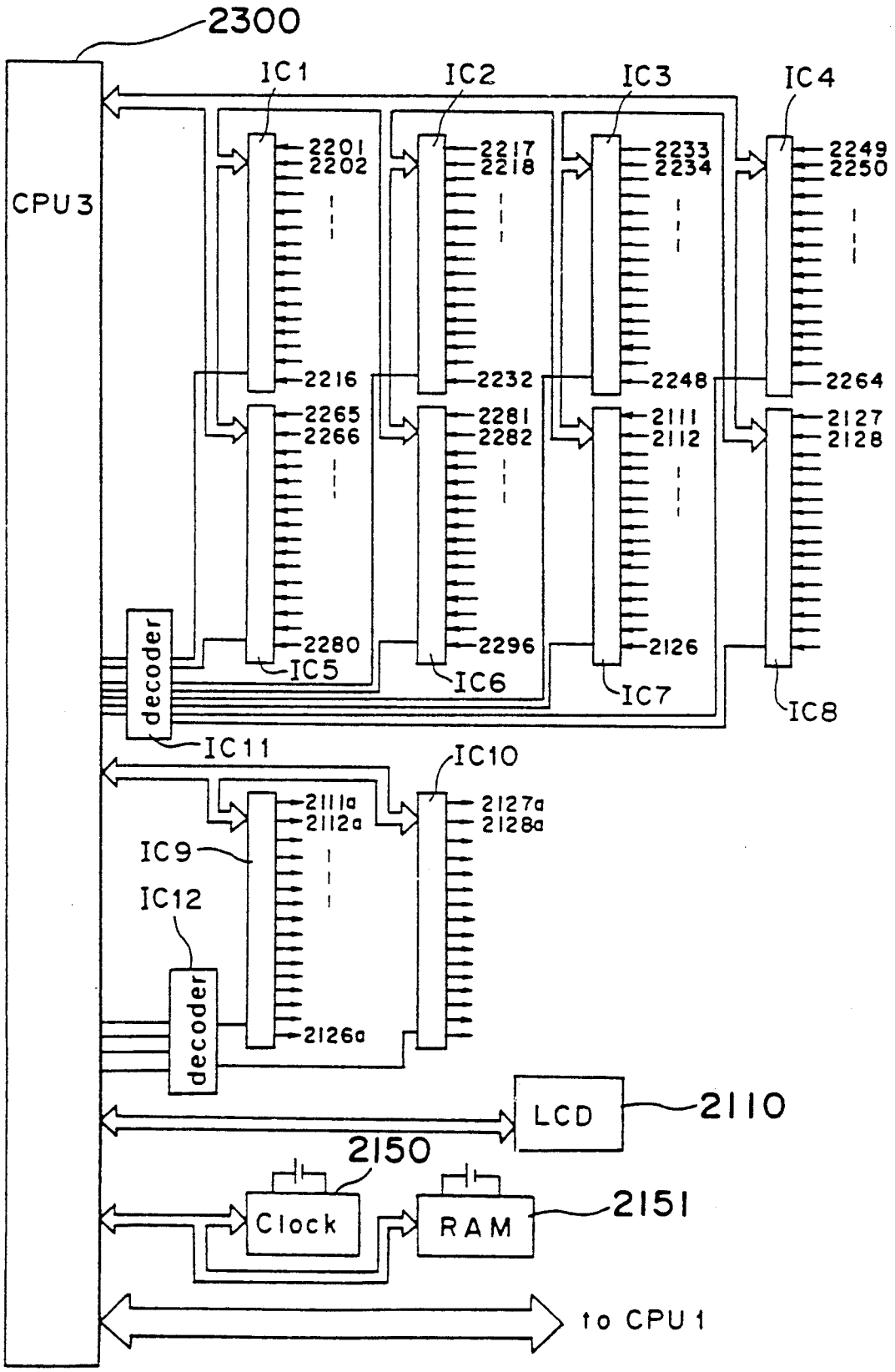
FIG. 17 is an electrical circuit diagram of the third CPU which controls the editor.

FIG. 17 shows a circuit for controlling the editor 2000. The third CPU 2300 is connected to input-output circuit devices IC1 to IC10 such as 8243 of Intel, which are connected to keys 2201 to 2296 and 2111 to 2128 and the displays 2111*a* to 2128*a*. Decoders IC11 and IC12 are used for the selection of the devices IC1 to IC10. The third CPU 2300 is also connected to the liquid crystal display (LCD) panel 2110 and an integrated clock circuit 2150 and a RAM 2151 each with a back-up battery. The third CPU 2300 communicates data with the first CPU 201 through communication lines.

(c) Flow of the Control of Copying Machine

Figure 18:
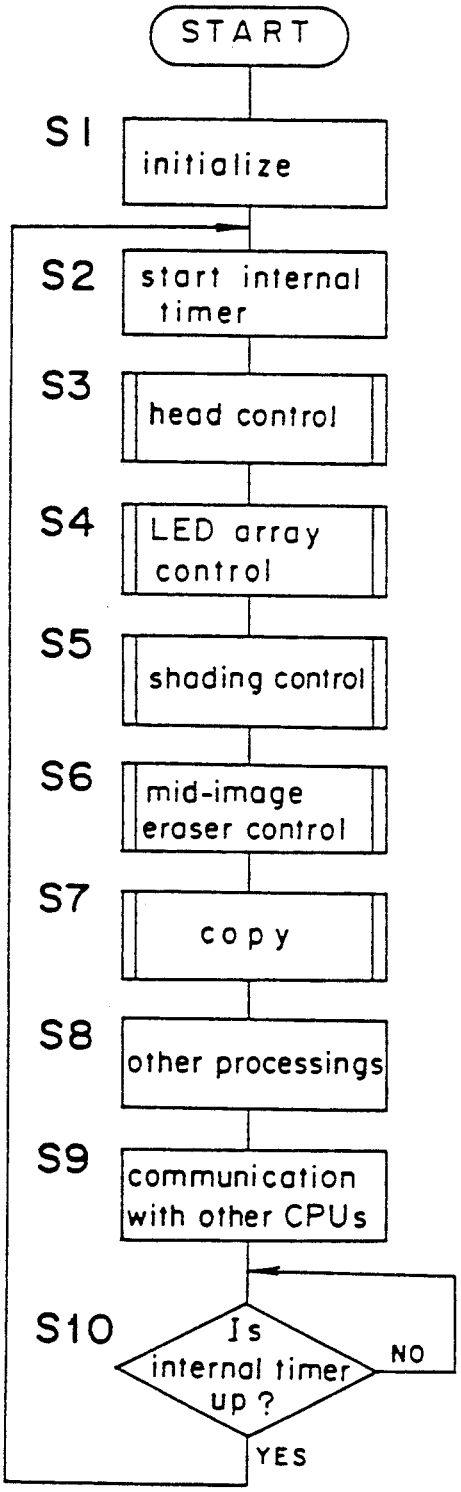
FIG. 18 is a chart of the main flow of the copying machine.

FIG. 18 shows the main flow of the first CPU 201. When the first CPU 201 is reset and the program starts, the first CPU 201 is initialized first; for example the RAM 202 is cleared and various registers are set, and the copying machine is set to the initial mode (step S1).

Next, an internal timer in the first CPU 201 whose value has been set in step S1 is started (step S2).

Then, following subroutines (step S3 to S8) shown in the flowchart are called successively: head control routine for controlling the position of the LED head 1201 (step S3), LED array control routine for controlling the lighting of the LED array 1202 (step S4), shading control routine of opening and shutting the shading shutter 1206 or the liquid crystal shutter 1210 (step S5), mid-image eraser control routine for controlling the mid-image eraser 1100 (step S6), copy routine for copy (step S7) and other processings (step S8).

Then, the first CPU 201 communicates with other CPUs (step S9).

If the internal timer is up (step S10) after every subroutine are completed, one routine of the main flow ends, and the program returns to step S2.

Figure 19:
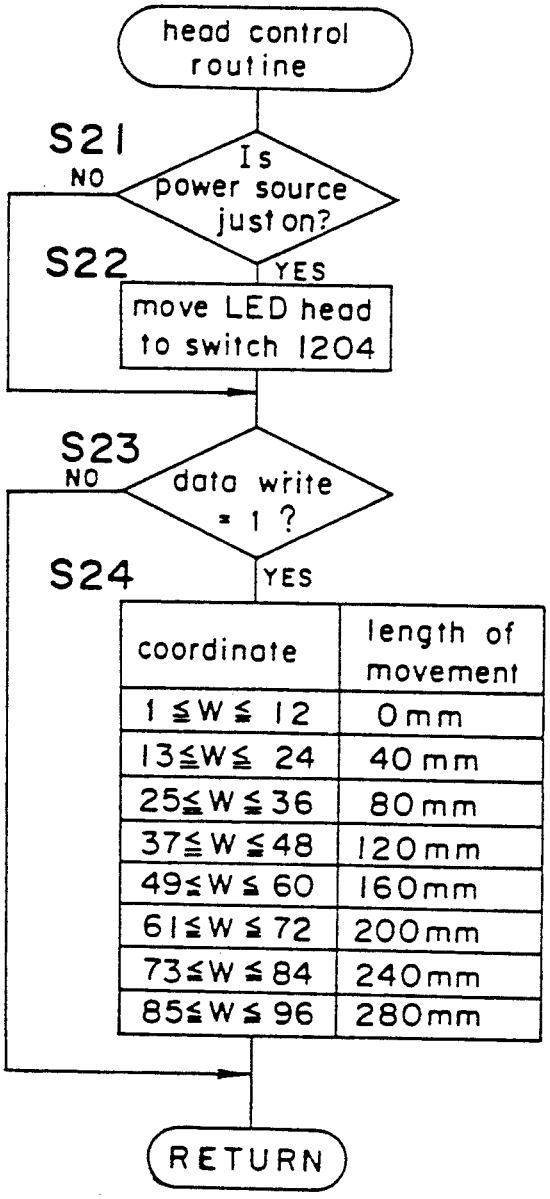
FIG. 19 is a flowchart of head control routine.

FIG. 19 shows the head control routine (step S3). If the electric power source is just supplied (step S21), the LED head 1201 is moved to an end till the switch 1204 is turned on (step S22). Then, if the data-write signal becomes "1" (step S23), the LED head 1201 is moved by an amount shown in the table according to the coordinate W of the region for the data to be written parallel to the axial direction of the drum 1 (step S24). For example, if the coordinate W is in the region between the first and twelfth squares, the LED head 1201 should be held still and the distance of the movement of the LED head 1201 is zero. If the coordinate W is in the region between 13th and 24th, the LED head 1201 should be moved by 40 mm being equal to the length of the LED head 1201 in the width direction because the position to be written is in an adjacent block in the width direction.

Figure 20:
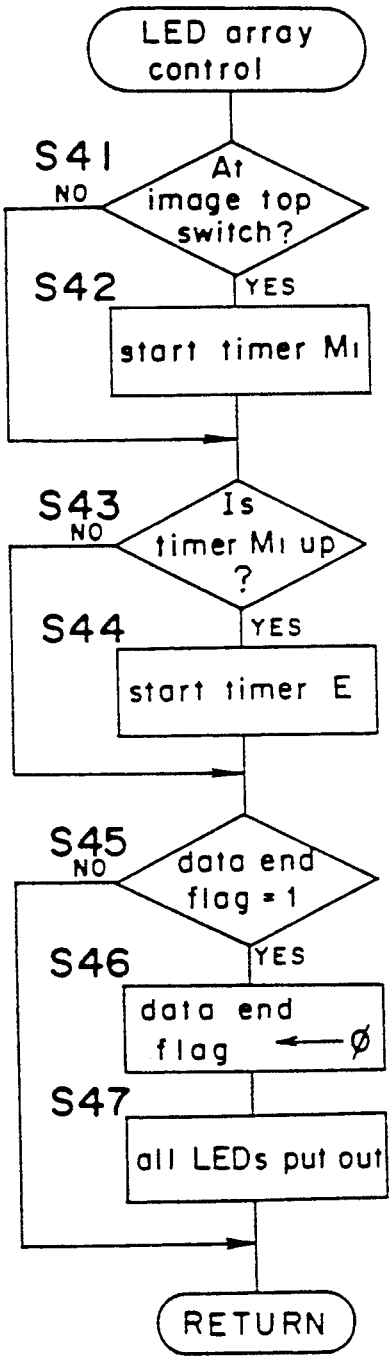
FIG. 20 is a flowchart of LED array control routine.

FIG. 20 shows the LED array control routine (step S4). If the second scanner of the optical system 11 turns on the switch 53 which locates at a position in correspondence with the top of an image area on the platen glass 12 (step S41), a timer M1 is started (step S42). The timer M1 is used for the start of the actuation of the LED head 1201 from the top of the image area. For example, if the writing area is designated to 4th square, the value of the timer M1 is set to a value obtained by following calculation 40 mm×(−1)/scan speed (wherein 40 mm is the length of one square).

If the timer M1 is up (step S43), another timer E is started (step S44). When an interruption takes place after the timer E is up, a write routine of the editor 2000 is started. The value of the timer E designates a lighting time per one dot data of LEDs of the LED array 1202. Because the width of an LED is equal to 1 mm in this embodiment, the value is set to 1 mm/drum speed or a time in that a LED illuminates by one unit length of 1 mm measured on the photoconductor drum 1. Thus, if a LED in the LED array 1202 is lighted in one unit of time, a square pattern of 1 mm×1 mm is erased.

Figure 21:
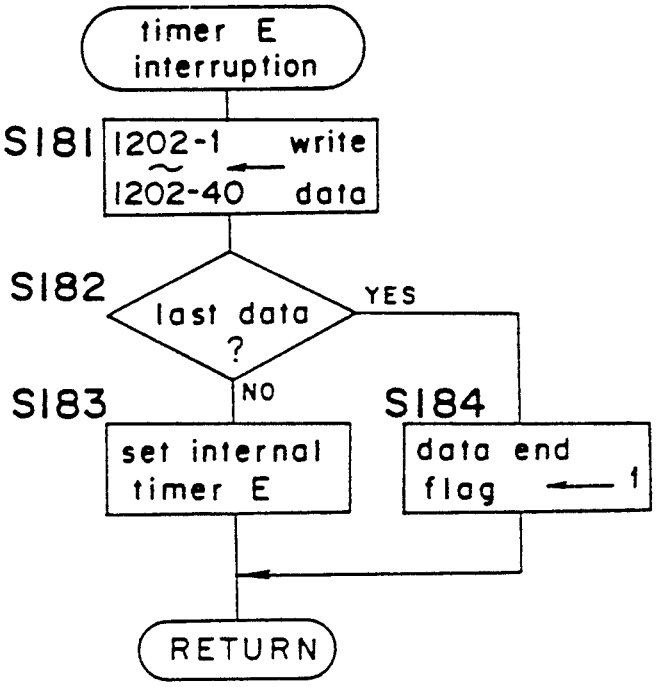
FIG. 21 is a flowchart of timer E interruption-handling routine.

If the data-end flag which designates the completion of data entry becomes "1" in a timer interruption routine shown in FIG. 21 (step S45), the data end flag is reset to be "0" because the data of 40 mm have been written (step S46), and all LEDs are put out (step S47).

FIG. 21 shows the internal interruption-handling routine which is executed after the timer E is up. If the count of the timer E is completed, an internal interruption occurs. Then, each LED of Nos. 1 to 40 of the LED array 1202 is controlled or lighted according to an entry data sent from the third CPU 2300 (step S181). If the entry data is not the last one (NO in step S182), the timer E is set (step S183); otherwise the data end flag is set to be "1" (step S184). When the internal timer E is not started, this interruption will not take place and the interruption-handling is completed.

Figure 22:
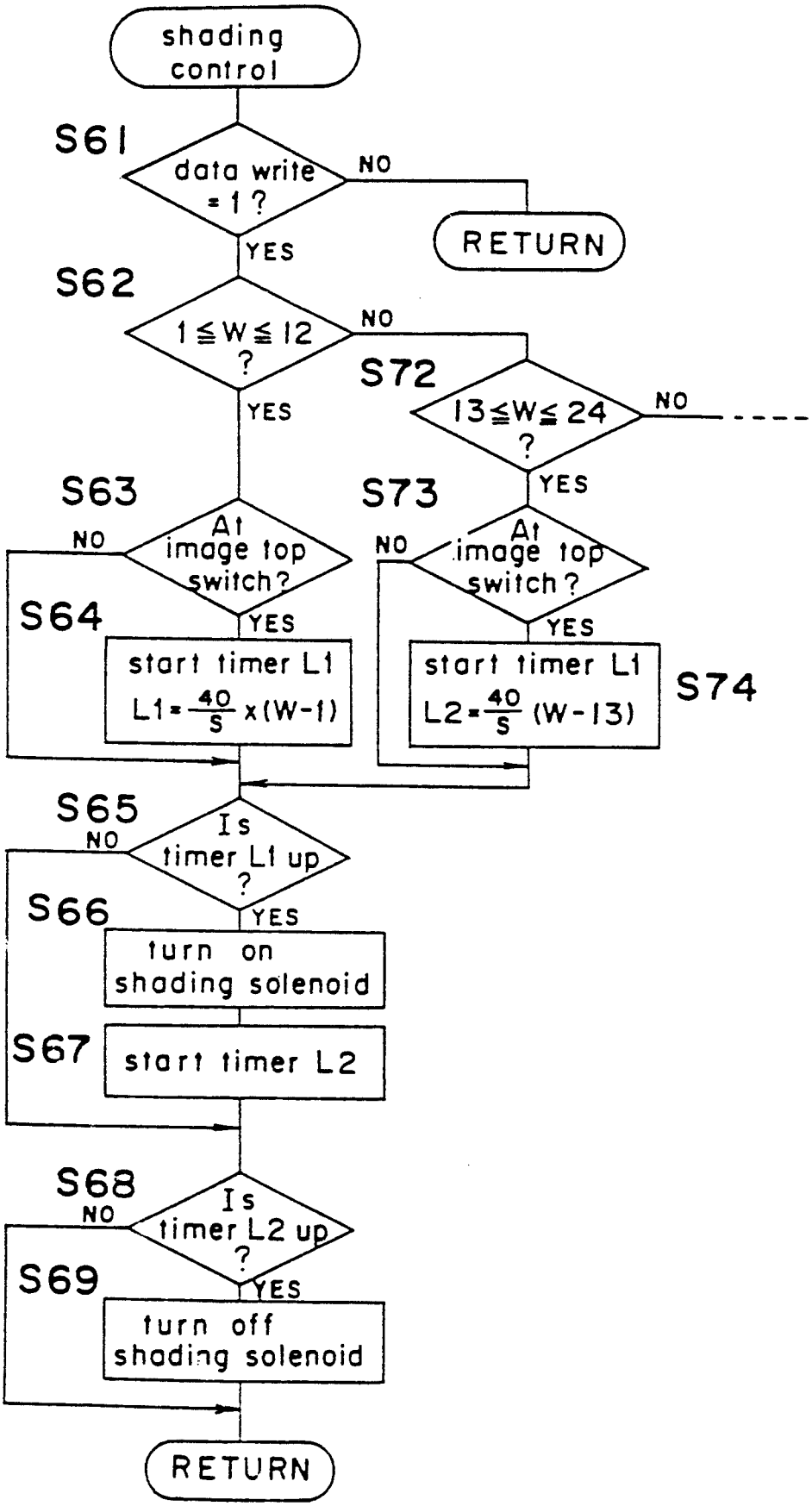
FIGS. 22 and 23 each are flowchart of shading control routine.

FIG. 22 shows the shading control routine (step S5) with use of the shading shutter 1206, wherein a timer L1 is used for closing the light path with the shutter 1206 by turning on the shading solenoid (not shown) from the top of an image in the width direction to a data write position W specified, and another timer L2 is used for the control of the opening time of the shutter 1206. If the data write signal is "1" (step S61), the shading solenoid is turned on as will be explained below. If the coordinate W for a data to be written is between 1 and 12 (step S62), the timer L1 of (W-1) ×40 mm/scan speed(s) is started (step S64) after the switch 53 is turned on at the top of an image (step S63). If the timer L1 for moving to the coordinate W is up (step S65), the shading solenoid is turned on (step S66) and the timer L2 of 40 mm/scan speed is started (step S67). After the timer L2 is up (step S68), the shading solenoid is turned off (step S69). Other rows from 13th to 24th to those from 85th to 96th are also processed similarly except the setting of the value of the timer L1.

Figure 23:
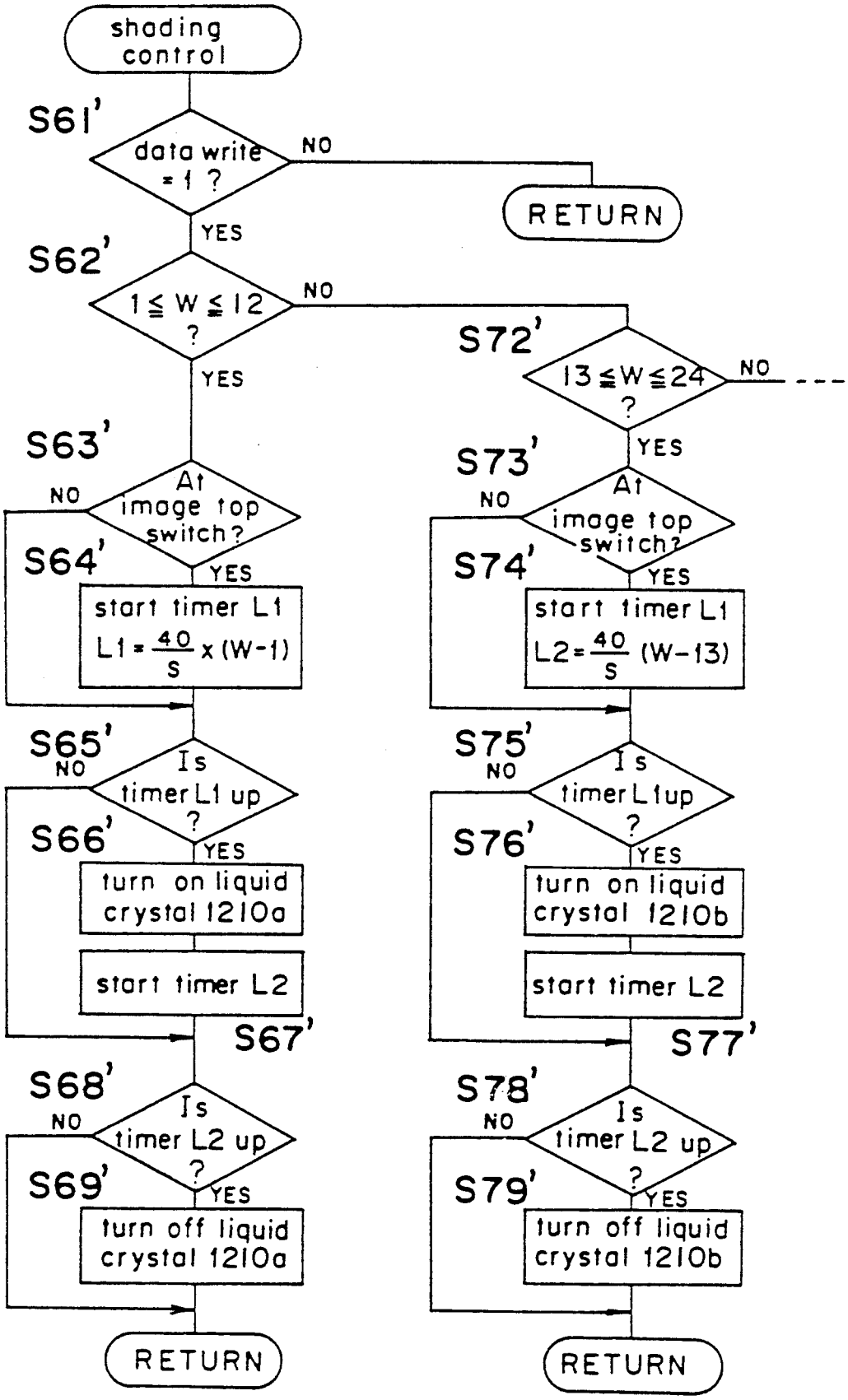

FIG. 23 shows another shading control routine (step S5) with use of a liquid crystal shutter 1210. This routine is similar to that shown in FIG. 22 with use of a shading shutter 1206.

If the data write signal is "1 (step S61'), one of liquid crystals 1210*a* to 1210*h* of the shutter 1210 is turned on according to the value of the coordinate W. If the coordinate W for a data to be written is between 1 and 12 (step S62'), the timer L1 of (W-1)×40 mm/scan speed is started (step S64') after the switch 53 is turned on at the top of an image (step S63'). If the timer L1 for the coordinate W is up (step S65'), the liquid crystal 1210*a* is turned on (step S66') and the timer L2 of 40 mm/scan speed is started (step S67'). After the timer L2 is up (step S68'), the liquid crystal 1210*a* is turned off (step S69'). Other rows from 13th to 24th to those from 85th to 96th are also processed similarly except a corresponding liquid crystal and the setting of the value of the timer L1.

Figure 24:
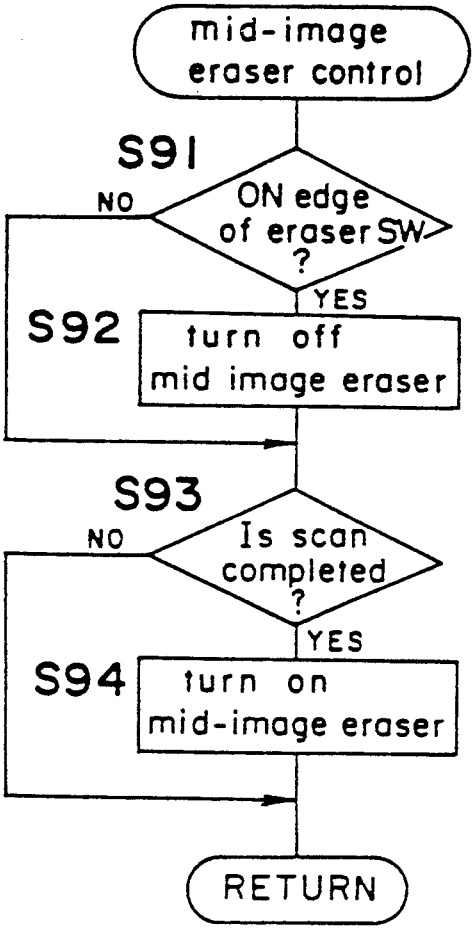
FIG. 24 is a flowchart of mid-image eraser control routine.

FIG. 24 shows the mid-image eraser control routine (step S6). If the first scanner of the optical system 11 turns on the switch 52 for erasing (step S91), that is, if a latent image remains on the drum 1, the mid-image eraser 1100 is turned off (step S92). If the scan is completed (step S93), the mid-image eraser 1100 is turned on (step S94).

FIG. 25 shows the control of copy (step S7). If the print switch 71 is pushed (step S101), the main motor M1, the development motor M2, the charger 4 and the transfer charger 7 are driven, and timers T-A and T-B for control are started (step S102). The timer T-A is used for the control of the driving time of the clutch of a paper feed roller, and the timer T-B is used for the control of the start of the scan.

Next, if the upper paper-feed device 20 is selected (step S103), the clutch of the device 20 is actuated (step S104). If the lower paper-feed device 22 is selected (step S105), the clutch of the device 22 is actuated (step S106).

Then, if the timer T-A is up (step S111), the clutch of the paper-feed roller 21 or 23 is stopped (step S112, S113).

Next, if the timer T-B is up (step S121), the scan motor M3 is actuated so as to start the scan action (step S122). After the timer T-B is up, the internal interruption routine (FIG. 21) is carried out and a data is written.

Then, if the timing signal is received during the scan action (step S131), the clutch of timing rollers 26 is actuated and a timer T-C for the control of the timing rollers 26 is started (step S132). The timing rollers 26 feed a paper to the photoconductor drum 1 in synchronization with the image.

Next, if the timer T-C is up (step S141), the charger 3, the scan motor M3 and the clutch of the timing rollers 26 are stopped, respectively (step S142). The value of the timer T-C can be varied according to the size of a copy paper or the like.

Then, if the optical system 11 returns to the fixed position (step S152) after it begins to return (step S151), the development motor M2 and the transfer charger 7 are stopped and a timer T-D for auto shut is started (step S153).

Next, if the timer T-D is up (step S161), the main motor M1 is stopped (step S162).

Finally, processings for various outputs are performed (step S171).

The timers T-A to T-D used in the above-mentioned flow are digital timers which are programed so as to be counted up by one for each flow of the copy routine being carried out in a prescribed time of the internal timer.

(d) Flow of the Control of the Editor

Figure 26:
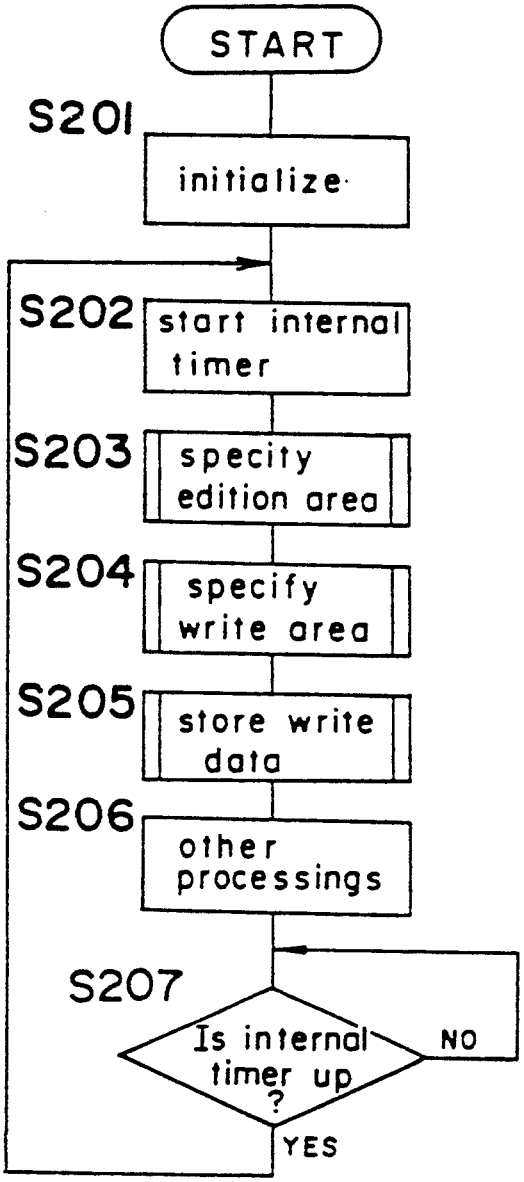
FIG. 26 is a chart of the main flow of an editor.

FIG. 26 shows the flow of the third CPU 2300 which controls the editor 2000. When the program starts after the third CPU 2300 is reset, the third CPU 2300 is initialized so as, for example, to clear out RAM 2151 and to set registers, and the editor 2000 is set in the initial mode (step S201). Next, an internal timer is started which is included in the third CPU 2300 and has a value set in step S201 (step S202). Then, the subroutines, shown in the flowchart, of the specification of an editorial area (step S203), the specification of a data write area (step S204), the store of write data (step S205) and other processings (step S206) are called successively. When the internal timer is up (step S207), one routine is completed, and the program returns to step S202. Various timers used in the subroutines are counted in the unit of the time length of this routine. In other words, the completion of any timer is decided according to a number of repetition of the flows of the main routine.

Figure 27:
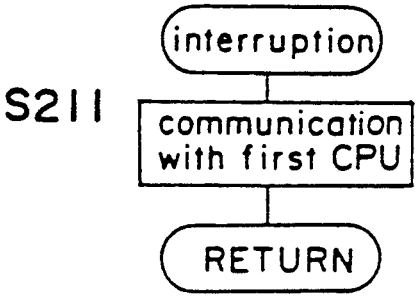
FIG. 27 is a flowchart of interruption-handling.

The communication of data with the first CPU 201 (step S211) is carried out by an interruption, as shown in a interruption-handing routine in FIG. 27, regardless of the main routine shown in FIG. 26.

Figure 28:
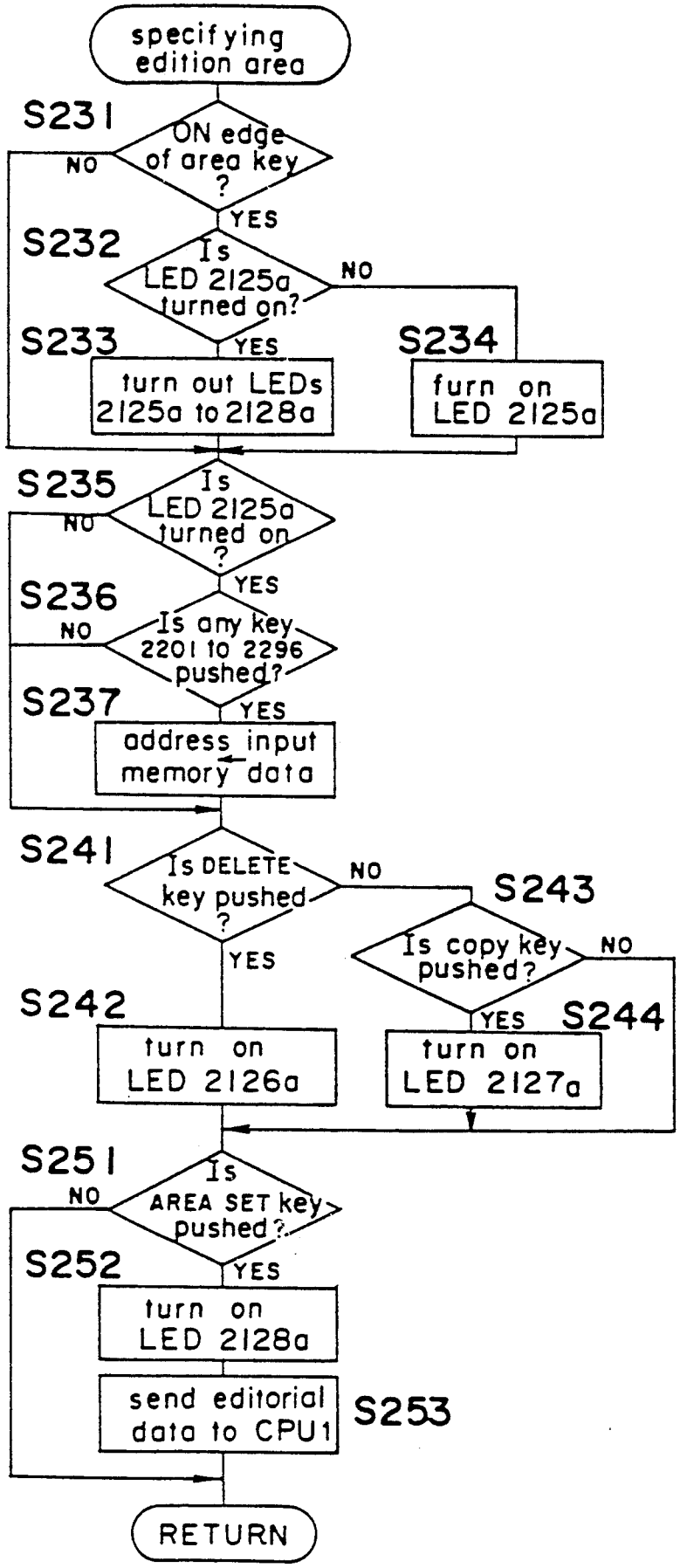
FIG. 28 is a flowchart of specifying edition area.

FIG. 28 shows a flow for specifying an editorial area (step S203). If the LED 2125*a* is lighted (step S232) at an "ON" edge ("0"→"1") of a signal of the AREA key 2125 (step S231), the LEDs 2125*a* to 2128*a* are turned out (step S233). If the LED 2125*a* is turned off (step S232) at an "ON" edge of a signal of the AREA key 2125 (step S231), the LED 2125*a* is lighted (step S234).

Next, if any of the keys 2201 to 2296 on the panel 2200 of the editor 2000 is pushed (step S236) when the LED 2125*a* is lighted (step S235) or if the editor 2000 is in the mode for entering the coordinates of an editorial area, the input data of the coordinates are stored in the address memory (step S237).

Then, if the DELETE key 2126 and the COPY key 2127 are pushed (step S241, S243), the LEDs 2126*a* and 2127*a* are lighted, respectively (step S242, S244).

If all input data are entered, the AREA SET key 2128 is pushed. At an "ON" edge of the signal of the AREA SET key 2128, the LED 2128*a* is lighted (step S252) and the entry data for image edition such as the coordinates, the deletion or the copy are sent to the first CPU 201 (step S253).

Figure 29A:
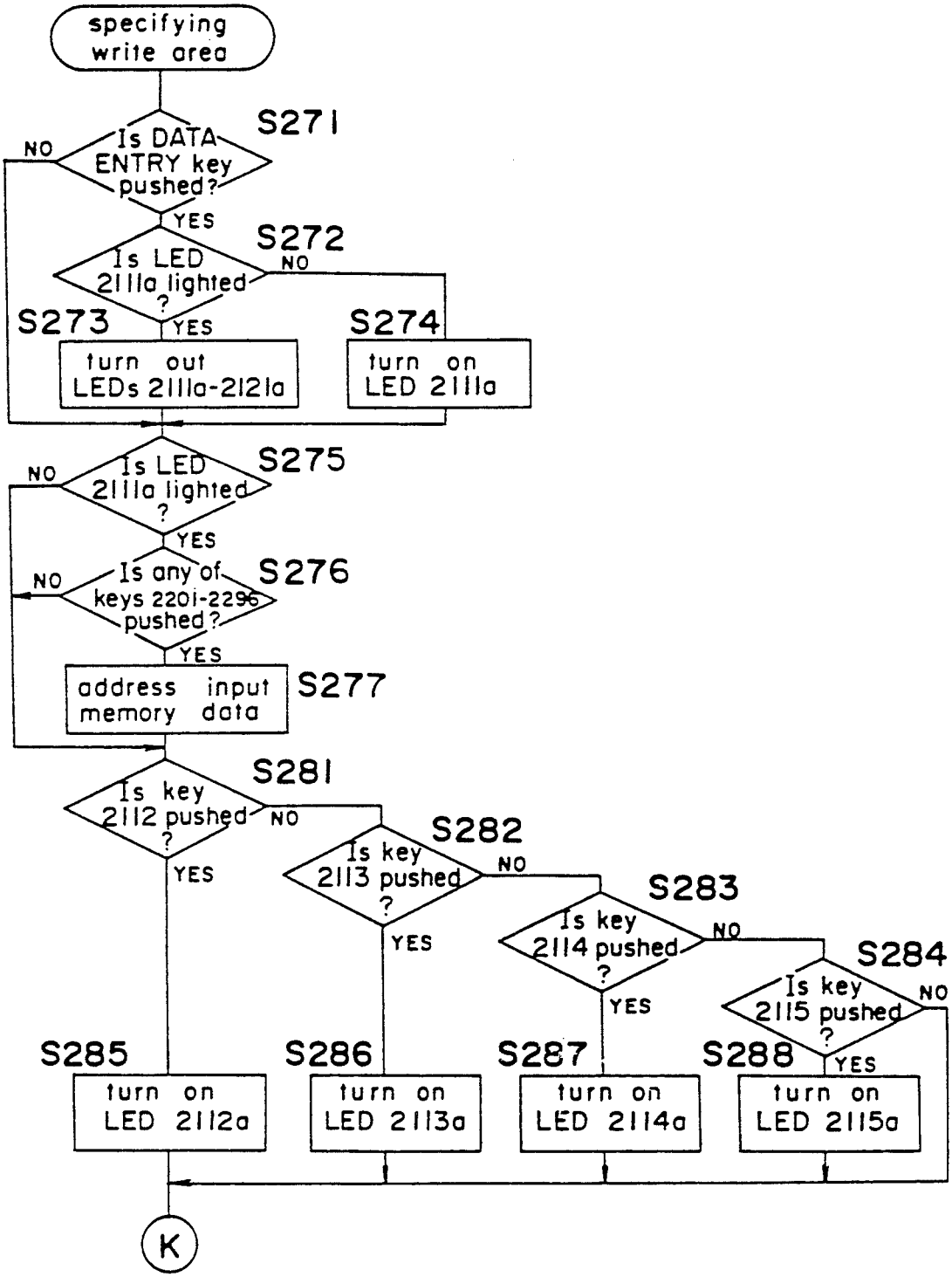
FIGS. 29 (*a*) and (*b*) are flowcharts of specifying write area.
Figure 29B:
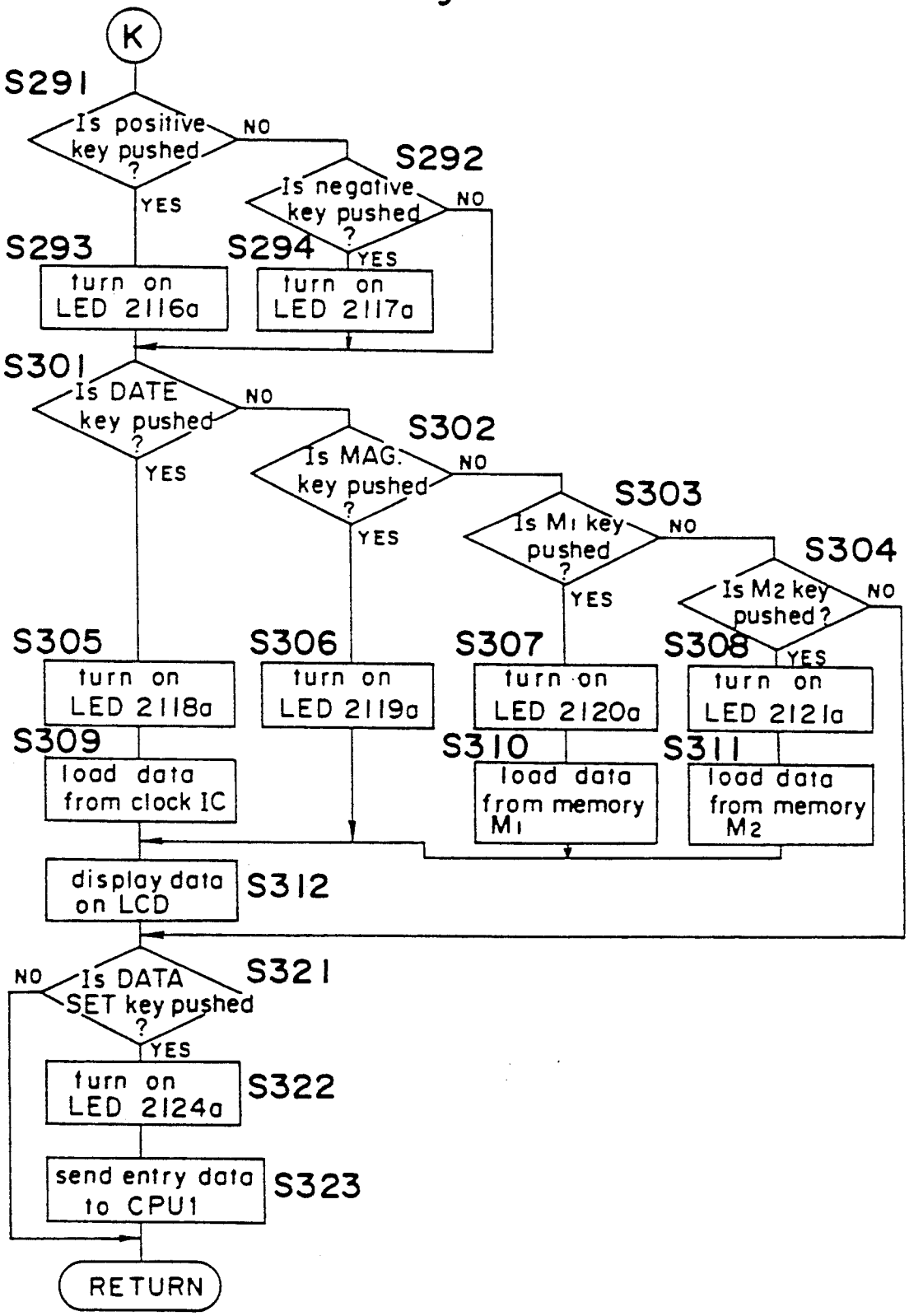

FIGS. 29(a) and 29(b) show a flow for specifying a write area (step S204). If the LED 2111*a* is lighted (step S272) at an "ON" edge of a signal of the DATA ENTRY key 2111 (step S271), the LEDs 2111*a* to 2114*a* are turned out (step S273). On the other hand, if the LED 2111*a* is turned out (step S272) at an "ON" edge of a signal of the DATA ENTRY key 2111 (step S273), the LED 2111*a* is turned on (step S274).

Next, if any of keys 2201 to 2296 on the panel 2100 of the editor 2000 is pushed (step S276) when the LED 2111*a* is lighted (step S275), the coordinates of the key is stored in the address memory as a write area data (step S277).

Then, if any of the keys 2112 to 2125 for specifying the direction (normal, right, reverse, left) of the data entry is pushed (steps S281 to S284), the LED 2112*a* to 2115*a* in correspondence to the pushed key is turned on (steps S285 to S288).

Next, if the positive key 2116 is pushed (step S291), the LED 2116*a* is lighted (step S293), while if the negative key 2117 is pushed (step S292), the 2117*a* is lighted (step S294).

If any of the DATE key 2118, the MAGNIFICATION key 2119, the M1 key 2120 and the M2 key 2121 for specifying the kind of the entry data is pushed (steps S301 to S304), the LED 2118*a* to 2121*a* in correspondence to the pushed key is lighted (steps S305 to S308). Further, in case of the DATE key 2118, the data of date obtained from the clock IC 2150 with a backup battery is loaded (step S309), and in cases of the M1 and M2 keys 2120 and 2121, an arbitrary data being set beforehand in memories M1 and M2 are loaded from the memory 2151 with a backup battery, respectively (step S310, S311). Then, the content of the entry data is displayed on the liquid crystal display (LCD) 2100 (step S312).

Next, if all data entry is completed and the DATA SET key 2124 is pushed, the LED 2124*a* is turned on (step S322) and the data for the entry such as the entry coordinates, the direction and the like are sent to the first CPU 201 (step S323) on an "ON" edge of the DATA SET key 2124 (step S321).

Figure 30:
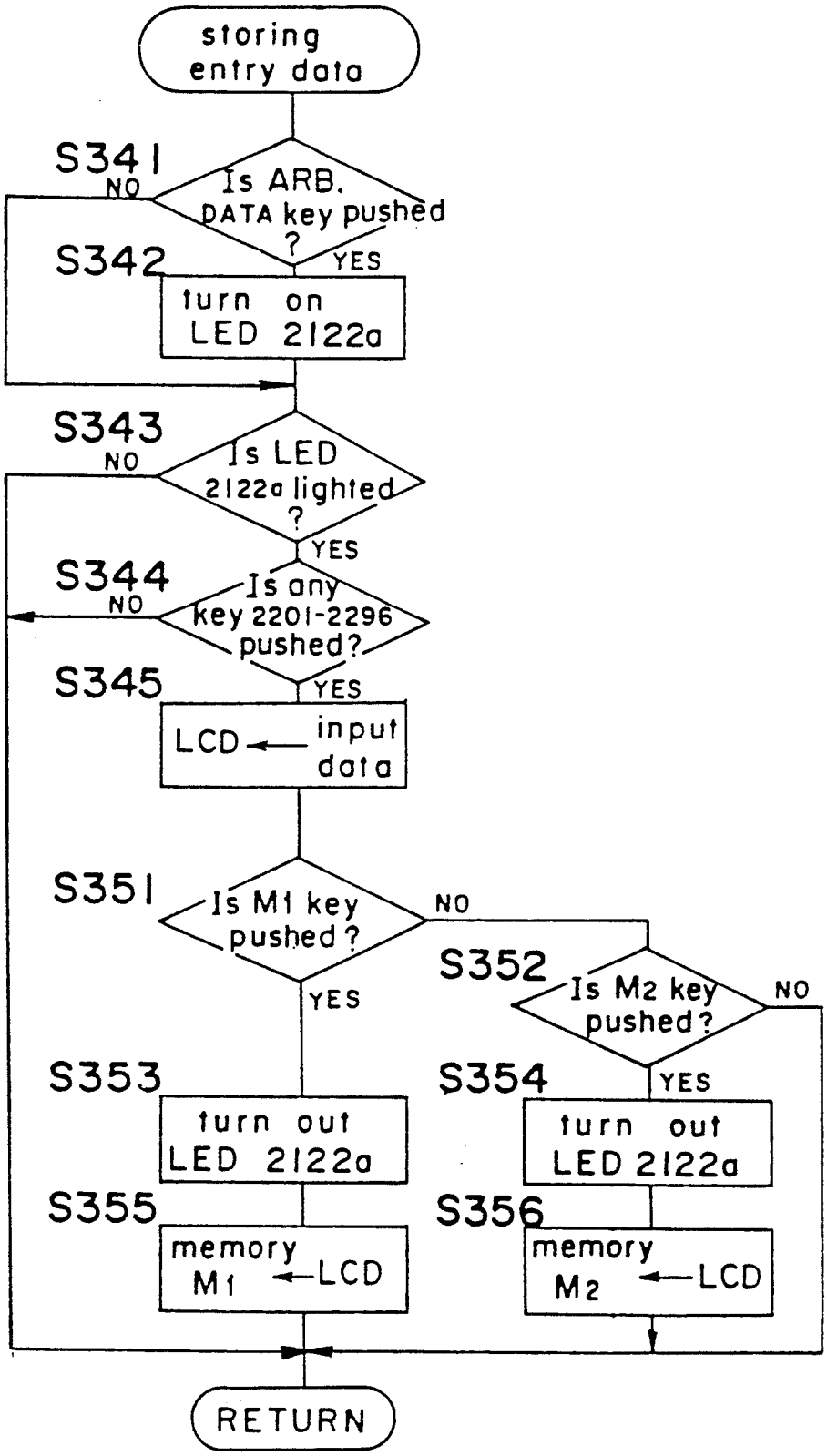
FIG. 30 is a flowchart of storing entry data.

FIG. 30 shows the flow for storing entry data (step S205). At an "ON" edge of the ARBITRARY DATA key 2122 (step S241), the LED 2122*a* is turned on (step S342). If any of the keys 2201 to 2296 on the panel 2200 is pushed (step S344) when the LED 2122*a* is lighted (step S343) or the editor 2000 is in a mode for entering characters of an arbitrary data, the input data is transformed according to the specified characters of the character panel shown in FIG. 16 so as to be displayed on the liquid crystal display 2110 successively (step S345).

Next, if the M1 or M2 key 2120, 2121 is pushed (steps S351 and S352), the LED 2122*a* is turned out (steps S353 and S354), and the data displayed in the liquid crystal display 2110 is stored in the memories M1 and M2 in the memory 2151 (step S356 and S357). Because the memory 2151 is backuped by a battery, the data is kept nonvolatile and unvanished after the storing.

This invention may be embodied in still other ways without departing from the spirit of essential characters thereof. For instance, while in the explained embodiments, data entry at a life-size copy is adopted. However, data entry at a copy of a variable magnification power is possible. Further, it is also possible to adopt data entry of a variable magnification power at a life-size copy, or data entry and copy both of life-size.

The preferred embodiments described herein are therefore illustrative and not restrictive, the scope of the invention being indicated by the appended claims and all variations which come within the meaning of the claims are intended to be embraced herein.

What is claimed is:

1. A data entry apparatus for an electrophotographic copying machine which forms an image of a document on a photoconductor and transfers the image to a paper, comprising:

manual data input means for enabling a subjective data to be created and entered by an operator;

a memory which is nonvolatile and capable of storing the data input by the data input means;

key means for inputting commands to read stored data in the memory;

position entry means for specifying an arbitrary area on the document on which the stored data is to be written; and data write means for writing the stored data read from the memory by the key means on the arbitrary area specified by the position entry means, whereby the data which has been previously input and stored can be written at the arbitrary area specified by said position entry means without again inputting the data.

2. A method for forming an image on copy paper by a copying machine from an original document comprising the steps of:

(a) inputting data to be written on the copy paper by a manual data input means;

(b) storing the data in memory;

(c) specifying a first area on the document on which the data is to be written;

(d) inputting a command to read the stored data in the memory without eliminating the stored data;

(e) controlling the copying machine to produce a copy which has a combined image including the image of the document and the image of the data read from the emory placed at the specified area on the document; and (f) repeating the steps of (c), (d) and (e) to produce another copy which places the data stored in the memory at a second specified area on the document.

* * * * *